US006889720B2

(12) United States Patent
Khokar

(10) Patent No.: US 6,889,720 B2
(45) Date of Patent: May 10, 2005

(54) METHOD AND MEANS FOR TEXTILE MANUFACTURE

(75) Inventor: Nandan Khokar, Göteborg (SE)

(73) Assignee: Biteam AB, Bromma (SE)

( * ) Notice: Subject to any disclaimer, the term of this patent is extended or adjusted under 35 U.S.C. 154(b) by 232 days.

(21) Appl. No.: 10/220,811

(22) PCT Filed: Mar. 6, 2001

(86) PCT No.: PCT/SE01/00476

§ 371 (c)(1),
(2), (4) Date: Dec. 16, 2002

(87) PCT Pub. No.: WO01/66840

PCT Pub. Date: Sep. 13, 2001

(65) Prior Publication Data

US 2003/0116218 A1 Jun. 26, 2003

(30) Foreign Application Priority Data

Mar. 6, 2000 (SE) ..... 0000721

(51) Int. Cl.[7] ..... D03D 41/00; D03D 47/20
(52) U.S. Cl. ..... 139/11; 139/438; 139/188 R
(58) Field of Search ..... 139/11, 437–448, 139/188 R–193, 188 A

(56) References Cited

U.S. PATENT DOCUMENTS 1,038,048 A 9/1912 Widmer et al.
3,788,360 A * 1/1974 Guallo ..... 139/447
3,955,602 A * 5/1976 King ..... 139/11
4,038,440 A * 7/1977 King ..... 442/205
5,076,330 A * 12/1991 Kimbara et al. ..... 139/11
5,228,481 A * 7/1993 Kimbara et al. ..... 139/11
5,394,906 A 3/1995 Farley

FOREIGN PATENT DOCUMENTS

| | | |
|---|---|---|
| EP | 0 484 541 A1 | 4/1991 |
| SU | 906-639 | 2/1982 |
| SU | 927-827 | 5/1982 |

* cited by examiner

*Primary Examiner*—Danny Worrell
(74) *Attorney, Agent, or Firm*—Harness, Dickey & Pierce, P.L.C.

(57) ABSTRACT

A method and device involve simultaneously inserting weft/binding yarns and beating them up, in textile manufacturing processes like 3D-weaving and uniaxial noobing. A yarn carrier is equipped with a beating-up reed dent. In the carrier, which includes a cartridge-like yarn supplying device, the yarn is arranged around two axes of rotation and it is enclosed in a case. It is particularly suitable for 3D textile-forming processes like 3D-weaving and uniaxial noobing because of its relatively low-height but high-width and hence the possibility of carrying relatively large amount of yarn. The yarn is contained on a flanged belt that can be driven either from within or from the outside. Such a cartridge-like yarn supplier is equipped with tips that are offset or displaced oppositely about the central axis. Such a displaced arrangement of the tips directs the carriers to lay yarn in two different paths, relative to a layer of warp/axial yarns, while traversing back and forth in the same linear path. Through such a method the 3D-weaving and uniaxial noobing processes can be made efficient.

42 Claims, 17 Drawing Sheets

METHOD AND MEANS FOR TEXTILE MANUFACTURE

FIELD OF THE INVENTION

This invention pertains in general to the field of textile manufacture. In particular, it concerns a method and means for supplying weft/binding yarn and beating-up. Such a means comprises a yarn carrier with a reed dent and is especially advantageous for processes like 3D-weaving and uniaxial noobing wherein multiple weft/binding yarns are required to be laid horizontally and vertically between the multiple layer warp/axial yarns and beaten-up. By employing such a means, the laying of weft/binding yarns and their beating-up can be achieved simultaneously, and hence the processes rendered efficient. To keep the textile-forming device compact, the yarn carrier is made relatively thinner and wider by arranging the yarn about two axes of rotation. To direct the yarn carrier back and forth in a linear path and yet be able to lay the weft/binding yarn in two different paths relative to a layer of the warp/axial yarns, the yarn carrier is provided with offset tips. Such a yarn carrier could also be useful in other textile processes.

BACKGROUND OF THE INVENTION

Different types of yarn packages are required for supplying yarns such as bobbins, pirns, cones, cheeses and spools. However, all these packages have one thing in common. The yarn always occurs about one axis of rotation. As a consequence, these packages of yarn happen to be cylindrical/conical and hence their thickness and width are equal when seen axially. However, depending on the functional requirement of a given process, either small or big diameter packages of yarn with suitable height/length are used. For example, a pirn that is used as a weft source in the weaving process is required to be diametrically smaller than the cone/cheese.

Unlike in the conventional 2D weaving process wherein one horizontal weft is picked, in the 3D-weaving and uniaxial type of noobing processes, which have been discussed in detail according to the listed references, multiple horizontal and vertical wefts/binding yarns have to be inserted alternately through the warp/axial yarns. This is because the warp/axial yarns are disposed in rows and columns arrangement and every row and column of yarns requires a corresponding weft/binding yarn. As in these 3D textile-forming processes the use of multiple weft/binding yarn transporting carriers or shuttles is preferable, it becomes necessary to keep the height of each yarn carrier as low as possible to enable simultaneous traversal of as many of them as possible in the limited space that is available to keep things manageable, simple and compact.

Further, in these 3D textile-forming processes it is desirable to maintain the vertical and horizontal layers of warp/axial yarns as closely as possible. Large spacing between the warp/axial yarns is disadvantageous. For example, it causes generation of high tensions in warp/axial yarns, renders a device bulky and hence not space saving, and is not helpful in achieving dense and well-structured 3D textile. Also, a close spacing of warp/axial yarns is desirable to manage easily the simultaneous insertion of a large number of either vertical or horizontal wefts/binding yarns. However, the conventional cylindrical package like the pirn is diametrically too large to be used in the said 3D textile forming processes. A pirn with its carrier, namely the shuttle, becomes even a larger system and will be obviously not preferable. This is also applicable to the type of shuttles and their yarn packages used in narrow or band weaving. If relatively smaller diameter pirns and shuttles are used (to have a low-height) then the cylindrical package will carry lesser amount of yarn. A package with relatively lower amounts of yarn will exhaust quickly necessitating frequent replacement with newer yarn packages. Consequently, a process requiring frequent stoppages for replacing exhausted yarn package with a fresh one will apparently be inefficient. The other disadvantages with the use of conventional yarn packages like the pirn are:

It cannot let off and take-up the weft yarn by itself to maintain uniform tension.

A twist is inserted in every round of yarn that is withdrawn axially.

It is vulnerable to contamination and damage.

These disadvantages are common for most prior art textile manufacturing methods and machinery, and especially for yarn holders being used therein.

As insertion of multiple wefts/binding yarns are involved in the processes under consideration, it is desirable to traverse the multiple means for yarn insertion in a linear path and under positive control to manage them properly. This will help to keep the textile producing machine compact and simple with as few working parts as possible. However, for these processes the conventional shuttle, including the types used in narrow/band weaving, which has its tips arranged in a linear alignment, is not suitable. This is because their back and forth traversal will have to be done in a rectangular path, and not the same linear path, to lay yarn either above/below or right side/left side of a given warp/axial yarn layer. As a result, the use of such a shuttle would necessitate wider spacing between the warp/axial yarns and consequently a compact, simple and efficient machine cannot be had. Also, it will be nearly impossible to control the multiple shuttles of a given direction if picked simultaneously between the boxes. Accordingly, it will be desirable to traverse the means for yarn insertion under positive control and in a linear path and yet be able to lay the yarn either above/below or right side/left side of a warp/axial yarn layer for rendering the machine simple and the process efficient.

Another major problem confronting the 3D-weaving and uniaxial type noobing processes is that of beating-up the multiple wefts/binding yarns that are alternately laid vertically and horizontally through the columns and rows of the warp/axial yarns. The beating-up reed and operation employed in the conventional 2D weaving process, including the types used in narrow/band weaving, cannot be applied to the 3D-weaving/uniaxial noobing processes. This is because the conventional beating-up reed is effective in positioning one 'horizontal' weft as its dents occur in a perpendicular orientation to the weft and a line contact is sufficient between the dents of the reed and the weft during the beating-up operation. The conventional reed with vertically oriented dents will not be effective in beating-up the wefts/binding yarns that also occur in the vertical direction as these yarns will tend to slip through the space between the dents.

Further, because in the 3D-weaving and uniaxial noobing processes multiple wefts/binding yarns are inserted alternately in the vertical and horizontal directions, these yarns are required to be beaten-up simultaneously in their respective directions to render the process efficient. Unlike in the conventional 2D-weaving process wherein only one weft is laid in the horizontal direction and the reed can make a line contact to beat it, in the 3D-weaving/uniaxial noobing processes the beating-up dents would be required to make a planar or areal contact as there will be more than one weft/binding yarns in a given direction to be beaten-up at the same time.

It follows now that the main reasons why the conventional shuttle, including the type used in narrow/band weaving, is unsuitable for use in the context of the 3D textile-forming processes are:

It is difficult to control the shuttle, in order to lay the yarn in two different paths relative to a layer of warp/axial yarns during its linear back and forth traversal, as its tips occur in a linear arrangement.

It is not traversed under positive control as it is thrown and there is no control over it during its flight from one box to the opposite.

It cannot be employed in the beating-up operation.

SUMMARY OF THE INVENTION

It is therefore an objective of the present invention to provide a method and an apparatus to at least partly overcome the above-mentioned problems associated with the prior art.

This objective is achieved with the invention as defined in the listed claims.

According to a first aspect of the invention a method for manufacturing a textile is provided, wherein at least one yarn insertion means (90; 39; 22) is operated for laying the yarn (45) through the warp/axial yarns (25), characterized in that the said yarn insertion means is also employable to perform a beating-up operation. Important advantages through this aspect will be that the textile manufacturing processes concerned will become efficient, textile manufacturing will be speeded-up, the textile machine will require relatively fewer working parts and the cost of the machine and its maintenance will be reduced.

According to the second aspect of the invention a yarn carrier for use in manufacturing a textile is provided, characterized in that the carrier (90) comprises a yarn carrying belt (15) on which yarn (45) is arranged, said belt (15) being turnable relative to the carrier (90) about at least two axes of rotation (X1 and X2). Important advantages through this aspect will be the availability of a yarn carrier having relatively low height and high width to be able to store sufficiently large amount of yarn, and the textile machine will not be bulky but become compact. Further, the yarn could be encased and thereby the risk of damaging and contaminating it will be reduced, and the warp/axial yarns will be spaced apart relatively closely with reduced tension build-up.

According to the third aspect of the invention a yarn carrier (90; 22) for use in textile production is provided, wherein it is traversed back and forth through layers of warp/axial yarns (25) to place the yarn (45) there between, said carrier (90; 22) comprising rotatable yarn holder on which the yarn (45) is arranged in a way to enable either the yarn's (45) removal from the carrier or winding it into the carrier, wherein the carrier (90; 22) is elongated in the direction of its traversal, and both end portions of the carrier in the said direction of traversal being tapered, characterized in that the tapered end portions are ended in tips (18*a*, 18*b*) occurring oppositely displaced to each other relative to the traversal direction of the carrier to render the carrier (90; 22) self-guiding to lay the yarn (45) in two different paths relative to a layer of warp/axial yarn (25) while the carrier (90; 22) traverses back and forth. Important advantages through this aspect will be that the process will be rendered efficient, relatively fewer working parts will be required in machine and the working of the machine will be relatively simplified.

According to a fourth aspect of the invention, a yarn insertion means such as a yarn carrier (90; 22) or a rapier system (39) is provided for use in textile production, wherein it is traversed back and forth through layers of warp/axial yarns (25) to place the yarn (45) there between, characterized in that it further comprises beating-up reed dent (27; 28') extending in the direction towards the fabric-fell (29) when the insertion means is traversed and comprising at least one inclined portion (27*b*; 28*b*) adjacent to its farthest extended part (27*c*; 28*c*). Important advantages through this aspect will be that the yarn laying and beating-up operation can be carried out in one step, the process will be rendered efficient, textile production will be speeded-up, relatively fewer working parts will be required in a machine.

As can be inferred now, it will be desirable to have a yarn package that has relatively low height, but is still able to store sufficiently large amount of yarn. To have a package of low height, the yarn should be made to occur about two parallel axes of rotation so that the yarn is disposed about the space separating the two axes. This way, for a given distance between the two parallel axes, a package of either relatively lower height and greater width or lower width and greater height can be produced. Further, the yarn of specified arrangement can also be encased. A cartridge-like yarn supply source as this can be advantageous in situations and for reasons just stated.

As the constructional design of the conventional shuttle has its tips arranged in a linear alignment, its use in the 3D-weaving and uniaxial noobing processes becomes unsuitable. This is because they have to be traversed in a rectangular path to lay the yarn either above/below or left/right side of a horizontal or vertical warp layer respectively. Such traversal of the multiple shuttles will be undesirable for reasons mentioned earlier. This problem can be overcome by having the tips of the present carrier arranged oppositely displaced about the longitudinal axis of the yarn carrier. By incorporating such guiding tips or noses the carrier can be rendered self-guiding as it can be directed in the same linear path and yet lay the yarn in two different paths. Further, the traversal and control of the carrier also stand to be simplified.

As in these textile forming processes the two sets of weft/binding yarn carriers are required to be moved alternately in a mutually perpendicular direction, the processes under consideration offer the unique possibility to make use of one set of weft/binding yarn carriers to beat-up the wefts/binding yarns of the other set that have been laid previously. Such a beating-up can be achieved if either all or select cartridge-like yarn carriers can be equipped with a certain beating-up dent. The beating-up operation so carried out will be of an innovative non-reciprocatory type. Through such an approach the picking and beating-up operations can be carried out in one step and thereby uniquely render the 3D textile-forming processes efficient.

On the basis of above discussions the present invention preferably provides one or several of the following features, and preferably all of them in combination:

A cartridge-type means for yarn supply and transport being provided with a dent so that the beating-up operation can be carried out, The method in which the picking and beating-up operations are carried out simultaneously, A means for supplying yarn in which the yarn occurs about two parallel axes of rotation, A means for yarn supply that lets off and takes-up yarn under positive action, A means for yarn supply that does not introduce a twist in the yarn that is being withdrawn out, A cartridge-type means for yarn supply in which the yarn is encased and the risks of contaminating and damaging it are minimised, The cartridge-like means for yarn supply being suitable for transporting the contained yarn, The cartridge-like yarn supplier being provided as a self-guiding carrier that can lay the yarn in two different paths in its linear back and forth traversal, and To make the 3D-weaving and uniaxial noobing processes efficient.

Other objectives and advantageous features of the invention are disclosed in the dependent claims and in the description of the preferred embodiments given below.

BRIEF DESCRIPTION OF THE DRAWINGS

For exemplifying purposes, the invention will be described in closer detail in the following with reference to embodiments thereof illustrated in the attached drawings, wherein.

DESCRIPTION OF THE PREFERRED EMBODIMENTS

The essential details of the cartridge-like means for supplying yarn and its employment as a yarn carrier and in the beating-up operation according to the present invention will be described now in reference to the FIGS. 1–15.

Figure 1:
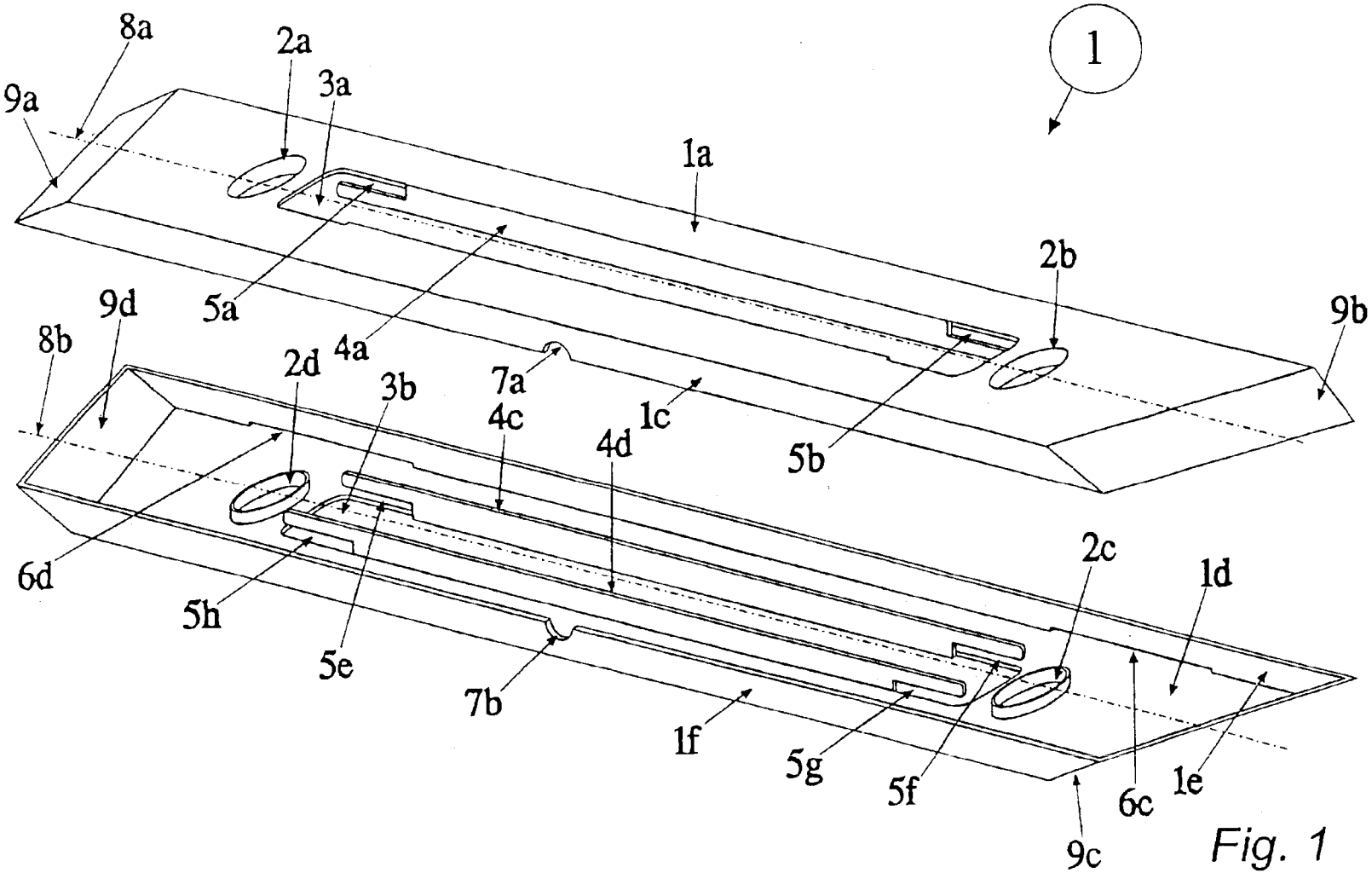
FIG. 1 shows the constructional features of the two halves of the cartridge case.

FIG. 1 shows the split views of the cartridge case (1) that will contain the supply yarn. The constructional details of the top (1*a*) and bottom (1*d*) halves of the case (1) have been indicated. Both the halves (1*a* and 1*d*) are identical in construction. Accordingly the various details are explained jointly. The top (1*a*) and bottom (1*d*) parts of the cartridge case (1) have front (1*c* and 1*f*) and back (1*b* and 1*e*) walls. The back wall (1*b*) is not shown in the view of the case (1*a*) in FIG. 1 but it exists just as the indicated back wall (1*e*) of the bottom half (1*d*). The back walls (1*b* and 1*e*) are longer than the front walls (1*c* and 1*f*). The top half (1*a*) has a pair of ring-like circular openings (2*a* and 2*b*) and similarly the bottom half (1*d*) has the pair of ring-like circular openings (2*c* and 2*d*). There is also a longitudinal opening (3*a* and 3*b*) on top and bottom halves respectively. Each of these longitudinal openings (3*a* and 3*b*) has a pair of back (4*a* and 4*c*) and front (4*b* and 4*d*) walls respectively. The front wall (4*b*) is not shown in the view of the case (1*a*) in FIG. 1 but it exists just as the indicated front wall (4*d*) of the bottom half (1*d*).

At the end sides of each of the walls (4*a*–4*d*) an opening (5*a*–5*h*) is provided as shown (openings (5*c* and 5*d*) are not shown but is similar to openings (5*g* and 5*h*)). Each of these openings (5*a*–5*h*) is level with the inner surface of the corresponding case parts (1*a* and 1*d*). Similarly, there are openings (6*a* and 6*b*) on the back wall (1*b*) of the case (1*a*), which however are not visible in the shown view of FIG. 1. This pair of openings (6*a* and 6*b*) exists just like the pair of openings (6*c* and 6*d*) in the wall (1*e*) of bottom case (1*d*) shown in FIG. 1. Each of these openings (6*a*–6*d*) has one of its long sides level with the inner surface of the corresponding case parts (1*a* and 1*d*) as indicated in FIG. 1. Each of the openings (6*a*–6*d*) occur equally about the diameters of the ring-like openings (2*a*–2*d*) respectively. Although only the openings (5*e*–5*h* and 6*c*–6*d*) of the bottom case (1*d*) will be utilised to accommodate a wheel to be described, similar openings (5*a*–5*d* and 6*a*–6*b*) on the top case (1*a*) is provided to allow easy interchange of the two case parts (1*a* and 1*d*). Such an interchangeability of parts can be advantageous in its manufacture and replacement.

An opening (7*a* and 7*b*) is provided at the front walls (1*c* and 1*f*) of the cases (1*a* and 1*d*) respectively as shown in FIG. 1. These openings (7*a* and 7*b*) occur midway and at the open side of the corresponding walls (1*c* and 1*f*). The purpose of these openings (7*a* and 7*b*) is to receive a suitable yarn guide through which the yarn would pass either into or out of the cartridge (1). Such an opening could also be provided at another suitable location depending on how and where the cartridge is to be employed. The yarn guide is not indicated.

The longitudinal opening (3*a*) and the pair of circular openings (2*a* and 2*b*) of the case (1*a*) occur symmetrically about the indicated axis (8*a*). Similarly, the longitudinal opening (3*b*) and the pair of circular openings (2*c* and 2*d*) of case (1*d*) occur symmetrically about the indicated axis (8*b*).

Figure 2:
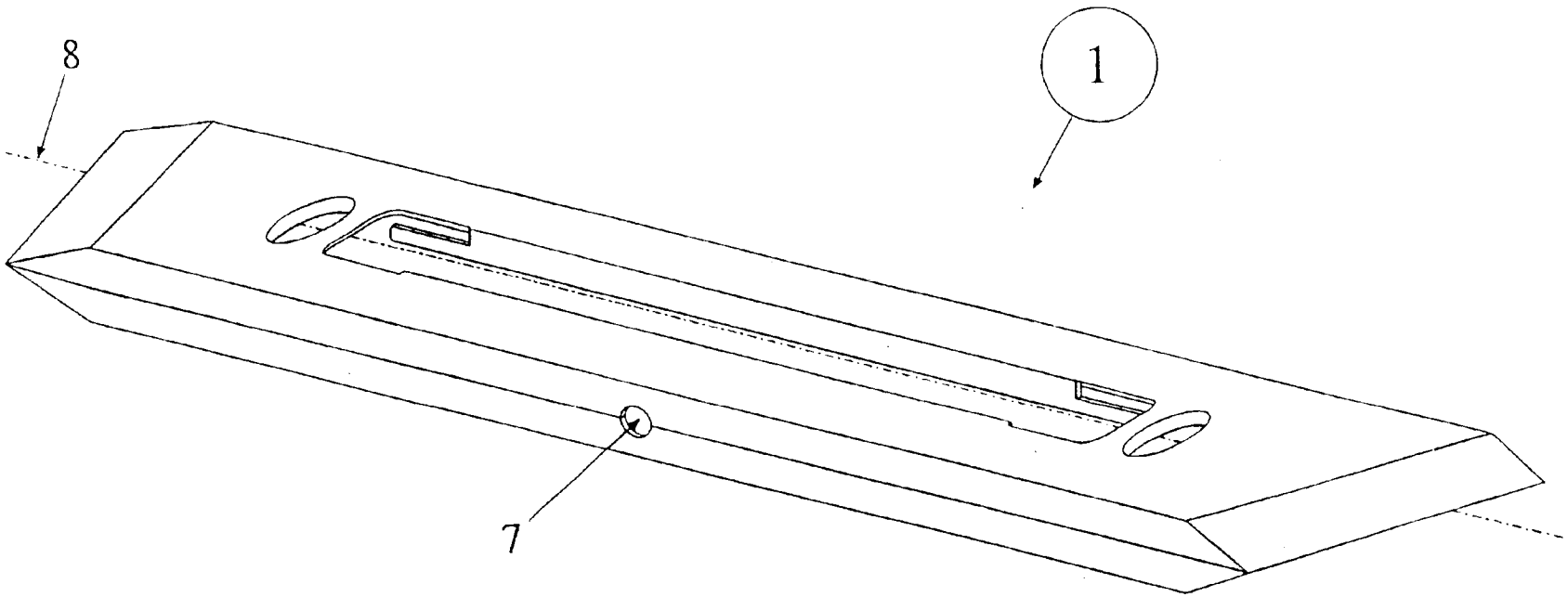
FIG. 2 shows the assembled cartridge case.

The ends at the sides of each of the case parts (1*a* and 1*d*) are tapered in two senses as shown in FIG. 1. The first taper that occurs is in the cases (1*a* and 1*d*) width direction because the back walls (1*b*/1*e*) are longer than the front walls (1*c*/1*f*). The second taper (9*a*–9*d*) is in the thickness direction of the case (1*a* and 1*d*) as indicated in FIG. 1. These two tapers are provided to aid easy entry of the cartridge (1) between the closely spaced warp/axial yarns and thus render the cartridge (1) suitable for transporting yarn. The two halves (1*a* and 1*d*) when joined together will result in a cartridge case (1) and is indicated in FIG. 2. The two parts (1*a* and 1*d*) could be joined in many different ways and it is unnecessary to describe them here. The indicated axis (8) may be regarded as the central axis of the carrier (1).

It may be mentioned here that without the tapers in the cartridge case's width and thickness directions, the cartridge (1) will have flat ends (as the front (1*c*/1*f*) and back (1*b*/1*e*) walls will be of equal length). Such a flat-ended cartridge may not readily gain entry between the closely spaced warp/axial yarns and hence it may not serve as a proper yarn carrier. But it could anyhow be used as a stationary source for supplying warp/axial yarns in processes like 3D-weaving and uniaxial noobing and as a moving source for supplying braiding yarns in 2D and 3D-braiding processes.

The purpose of the described constructional details of cartridge case (1) will become clear from the description of the following constituting elements of cartridge (1).

Figure 3:
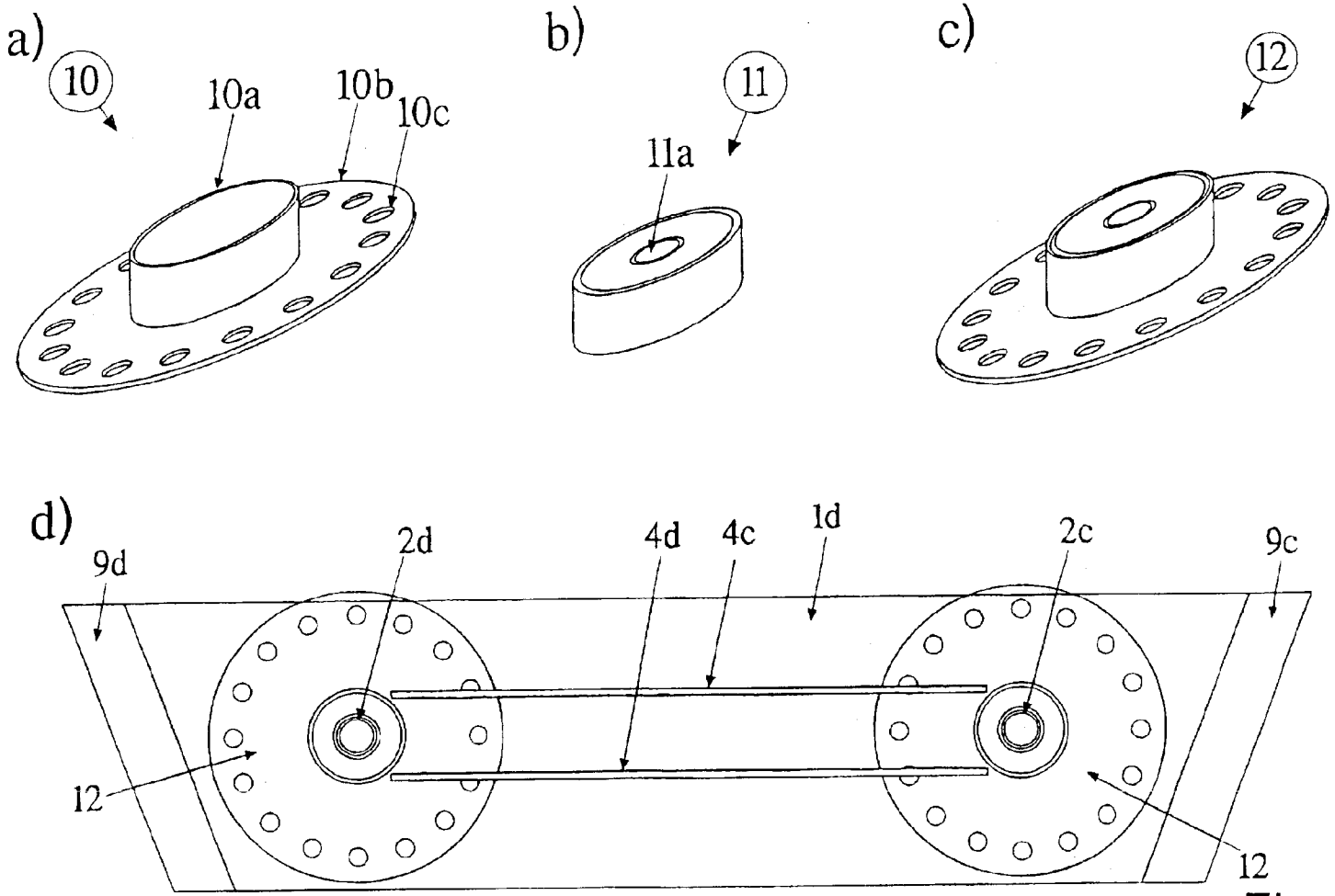
FIGS. 3*a, b, c* and *d* show the features of a wheel, a bearing, their assembly and their relative arrangement in the cartridge.
Figure 4:
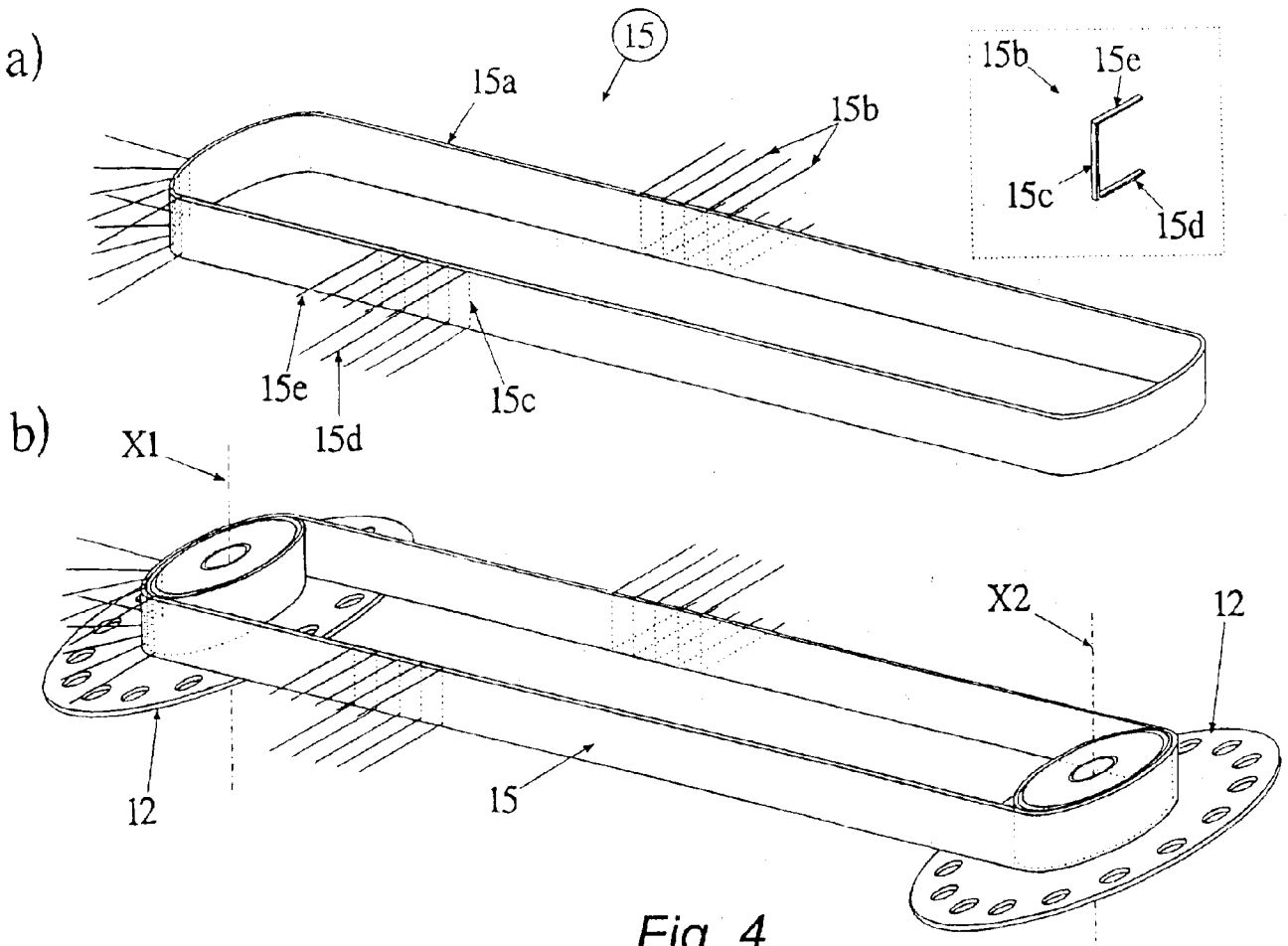
FIGS. 4*a* and *b* show the constructional features of a flanged belt and its mounting on wheels.

In FIG. 3 are shown the constructional features of a wheel (10), a friction reducing bearing (11) and the assembly (12) of the wheel (10) and the bearing (11). As shown in FIG. 3*a*, the wheel (10) has a ring (10*a*) and a flange (10*b*). The ring (10*a*) and flange (10*b*) occur concentrically attached to each other. While the inside of ring (10*a*) is for seating a bearing (11) indicated in FIG. 3*b*, the outside of ring (10*a*) is for receiving a flanged belt to be described later. Accordingly, to prevent slippage of the flanged belt, the outside of the ring (10*a*) can have either a rough surface or a construction such as teeth, serration, spikes, grooves etc. The flange (10*b*) has a series of equally spaced perforation (10*c*) located near the edge of the flange (10*b*). Alternatively, instead of the perforations (10*c*), there could be provided suitable serration on the flange (10*b*). The bearing (11) is a suitable friction reducing bearing having an axial opening (11*a*). The bearing (11) is seated in the ring (10*a*) of wheel (10) as shown in FIG. 3*c*.

Each cartridge (1) will require a pair of wheels (12). Each of these wheels (12) is located between the ring-like circular openings (2*a*/2*d* and 2*b*/2*c*) of the cases (1*a* and 1*d*) described earlier. The rings of these openings (2*a*/2*d* and 2*b*/2*c*) have a diameter suitable for seating in the opening (11*a*) of the bearing (11). This way the location of the pair of wheels (12) can be secured in position within the cartridge (1). Prior to mounting the pair of wheels (12) in the said locations, the flange (10*b*) of one wheel (10) is placed in the openings (5*e*/5*h* and 6*d*) and the flange (10*b*) of the other wheel (10) is placed in the opening (5*f*/5*g* and 6*c*) of the case (1*d*). The relative arrangement of the pair of wheel (12) and the bottom case (1*d*) is shown in FIG. 3*d*.

A flanged belt (15) of special construction, as shown in FIG. 4*a*, is needed for carrying yarn about two parallel axes of rotation. The special feature of the flanged belt (15) is that pins (15*b*) of ⊏-shape, as shown in the inset of FIG. 4*a*, are incorporated in the belt (15*a*). These ⊏-shaped pins (15*b*) are arranged in a series fashion throughout the belt (15*a*) and occur equally spaced apart. While the vertical section (15*c*) of the pin (15*b*) occurs in the lateral direction of the belt (15*a*) and helps to keep the pin (15*b*) secured to the belt (15*a*), the two horizontal arms (15*d*, 15*e*) of the pin (15*b*) protrude outwards in a direction perpendicular to the outer surface of the belt (15*a*). The horizontal sections (15*d*, 15*e*) of the pin (15*b*) are intended to function as a pair of flange on either side of the belt (15*a*) to prevent lateral displacement and sloughing off of the yarn that will be eventually carried on the belt (15*a*).

It suffices to mention here that a construction and function similar to the described flanged belt (15) can be obtained using suitable links in a chain and is unnecessary to detail here. Further, a flanged belt could also be produced in one piece using suitable polymeric materials. Also, it is not necessary for the cross-sectional shape of the flanged belt (15) to be of the ⊏-type as shown in FIG. 4*a*. It could be alternatively in the form of 'V', 'U' etc. shapes. Also, the flange sections (15*d* and 15*e*) could be made leaf-like and arranged partly over and under the adjacent leaves, such as the shutter of a camera, to control the yarn fully, especially when the belt bends about the wheel (12). Further, the backside of the belt need not necessarily be flat. It could have ribs or teeth or perforations or serrations or anti-slipping chemical coating etc. to prevent its slippage during running. Also, a suitable opening/slit can be provided on belt (15*a*) to enable hooking of the leading end of the yarn to enable its winding.

Figure 5:
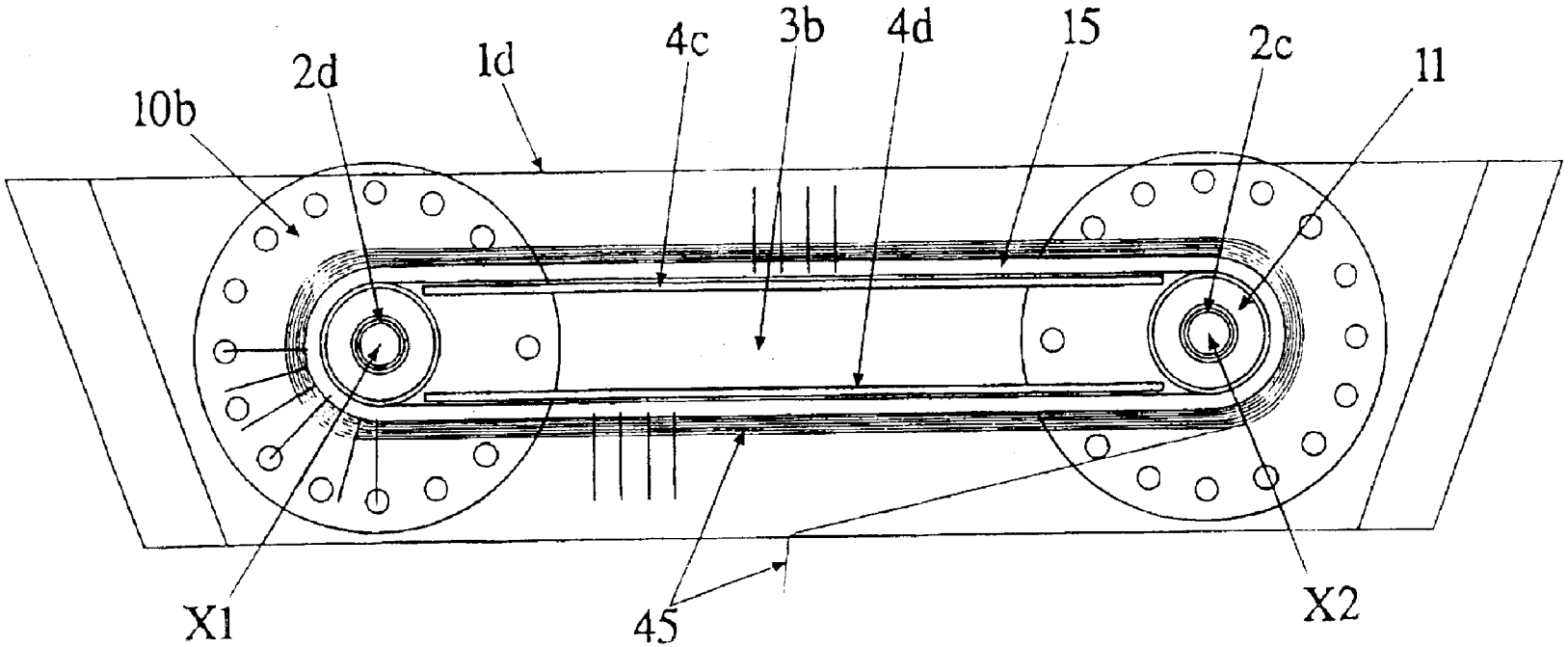
FIG. 5 shows the relative arrangement of the flanged belt with the wheels and cartridge.

In FIG. 4*b* is shown the flanged belt (15) mounted on the pair of wheels (12). In practice, the described flanged belt (15) will be mounted on the pair of wheel (12) that is seated in the case (1*d*) explained earlier in reference to FIG. 3*d*. As can be inferred from FIG. 4*b*, the yarn that will be carried on the flanged belt (15) will occur about two parallel axes of rotation (X1 and X2). FIG. 5 shows the yarn (45) occurring about axes (X1 and X2).

Due to tension in the yarn that will be wound on it, the straight sections of the flanged belt (15) can deflect towards each other or buckle inwards. As a consequence, the flanged belt (15) may not run properly. To prevent this inward deflection of the flanged belt (15) and to maintain it in a straight path, the walls (4*a* –4*d*) are incorporated in the top and bottom cases (1*a* and 1*d*) of carrier (1). These walls will provide the necessary support against the belt's (15) deflection when carrying yarn (45) as can be inferred from FIG. 5. If required, a block can also be incorporated in the openings (3*a* and 3*b*) for extra reinforcement.

The assembly of the cartridge case (1), the pair of wheel (12), the belt (15) and yarn (45) may now be referred to as the yarn supplying means or carrier (1*x*).

As multiple yarn supply sources have to be traversed simultaneously between either the rows or the columns of warp/axial yarns in the 3D textile-forming processes under consideration, it becomes desirable to keep their back and forth traversal linear in the same path. This is because the linear traversal of multiple yarn carriers allows to maintain the shortest possible distance between the layers of the warp/axial yarns and to have a simple mechanism for driving and managing the multiplicity of weft/binding yarn carriers under positive control. Also, it is desirable that the carriers gain easy and direct entry between the closely spaced warp/axial yarns and that it also deflects the warp/axial yarns laterally to move without hindrance. Such actions by the carriers are important to save space (and hence the over all sizes of the machine and the floor area requirement at the site of textile production) and to keep the traversal and related control mechanisms relatively simple.

Although the linear traversal of the yarn carrier in the same path is desirable for reasons just explained, it is also necessary at the same time that the yarn is laid in two different paths during the carrier's back and forth traversal. This is because in the 3D-weaving process the weft yarns have to be laid in the left/right sheds of the vertical direction and the upper/lower sheds of the horizontal direction during the carrier's corresponding back and forth traversal respectively. Similarly, in the case of the uniaxial noobing process, the yarn has to be laid at the left/right sides of the vertical layers and the top/bottom sides of the horizontal layers of the axial yarns respectively. If the weft/binding yarns are not laid in the two different paths of the respective directions mentioned, then the yarn that is laid by the carrier moving in one direction will be either pulled out or wrongly laid when the carrier moves in the opposite direction. As a consequence, the production of 3D textile will fail or an undesirable structure will result. It is therefore necessary that the yarn carrier while travelling linearly in the same path is able to guide itself directly into the required upper/lower/left/right sheds or top/bottom/left/right sides of the axial yarn layers. To achieve this, another pair of tapers, described next, is integrated to case (1). Such a pair of tapers, acts as a guiding nose to readily direct case (1) into either of the two required paths of the respective directions (horizontal/vertical) concerned during the carrier's (1*x*) linear back and forth traversal.

In FIG. 6*a* is shown the guiding nose (18) that can be attached to the carrier (1*x*). Such an attachment simplifies the manufacture of the case (1). The purpose of this guiding nose (18) is to direct the carrier (1*x*) in the same linear path during its back and forth traversal and yet make it capable of laying the yarn in two different paths. The guiding nose (18) is essentially a bar that has tapered ends. However, the novel feature of this guiding nose (18) is that its tips (18*a* and 18*b*) are offset or displaced oppositely about the central axis (18*c*) as shown in the figure. The tips (18*a* and 18*b*) do not lie in the same straight line as happens with the tips of a conventional shuttle. FIG. 6*b* shows a three-dimensional view of the guiding nose (18). In FIG. 6*c* is shown the relative arrangement of the guiding nose (18) and the carrier (1*x*). The assembly of the carrier (1*x*) and the guiding nose (18) may now be referred to as the self-guiding carrier (1*y*). It may be restated here that the offset or displaced tips (18*a*, 18*b*) could also be directly built into the case (1) without resorting to the use of bar (18), as will become known later.

It will be noticed in FIG. 6*c* that the guiding nose (18) is fixed at the rear side of the carrier (1*x*). By such a placing, the two tips (18*a* and 18*b*) do not occur along the central axis (8) of the case (1) indicated in FIG. 2. The two tips (18*a* and 18*b*) of the guiding nose (18) are thus offset in two senses about the axis (8) of the case (1), as the two axes (8 and 18*c*) of the case (1) and the guiding nose (18) respectively are not coincident. The guiding nose (18) is located at the rear side of case (1) to keep it close to the plane of shedding/axial yarn support so that the distance between the layers of warp/axial yarns can be kept low. As a consequence, the tension in warp/axial yarns can be kept low besides savings in space can be achieved.

Figure 7:
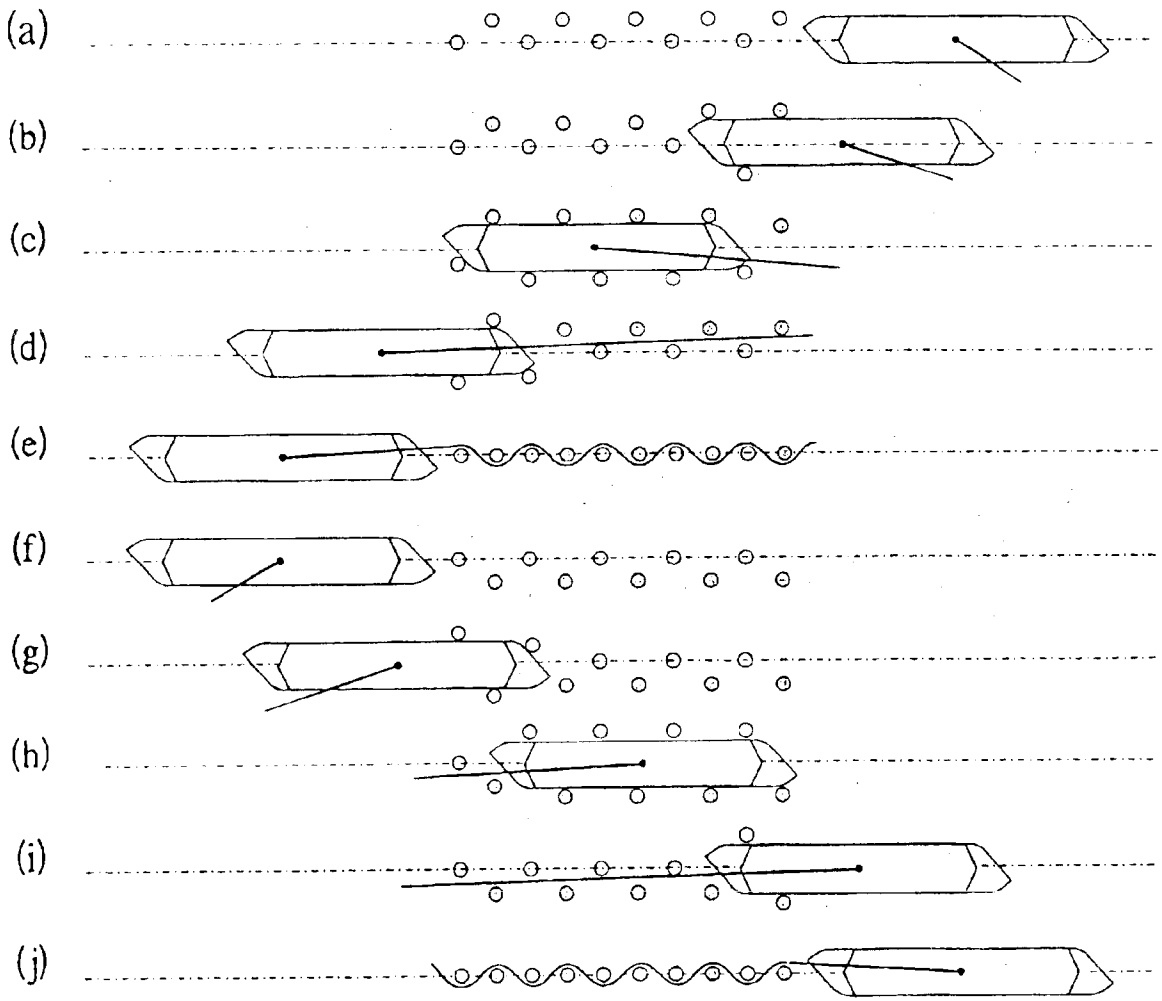
FIGS. 7*a*–7*j* show the sequence of traversal of the self-guiding yarn carrier in a cycle of the 3D-weaving process.
Figure 8:
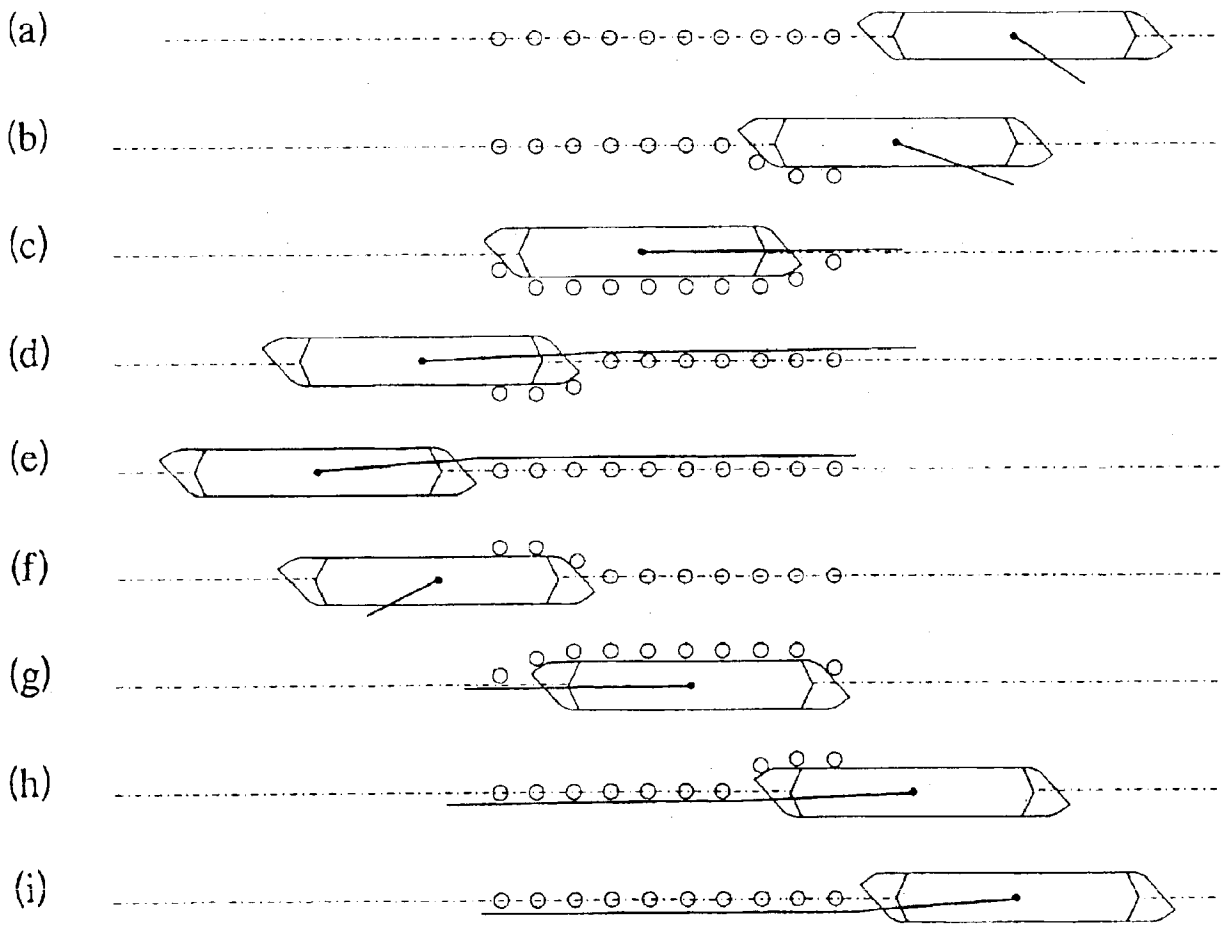
FIGS. 8*a*–8*i* show the sequence of traversal of the self-guiding yarn carrier in a cycle of the uniaxial noobing process.
Figure 9:
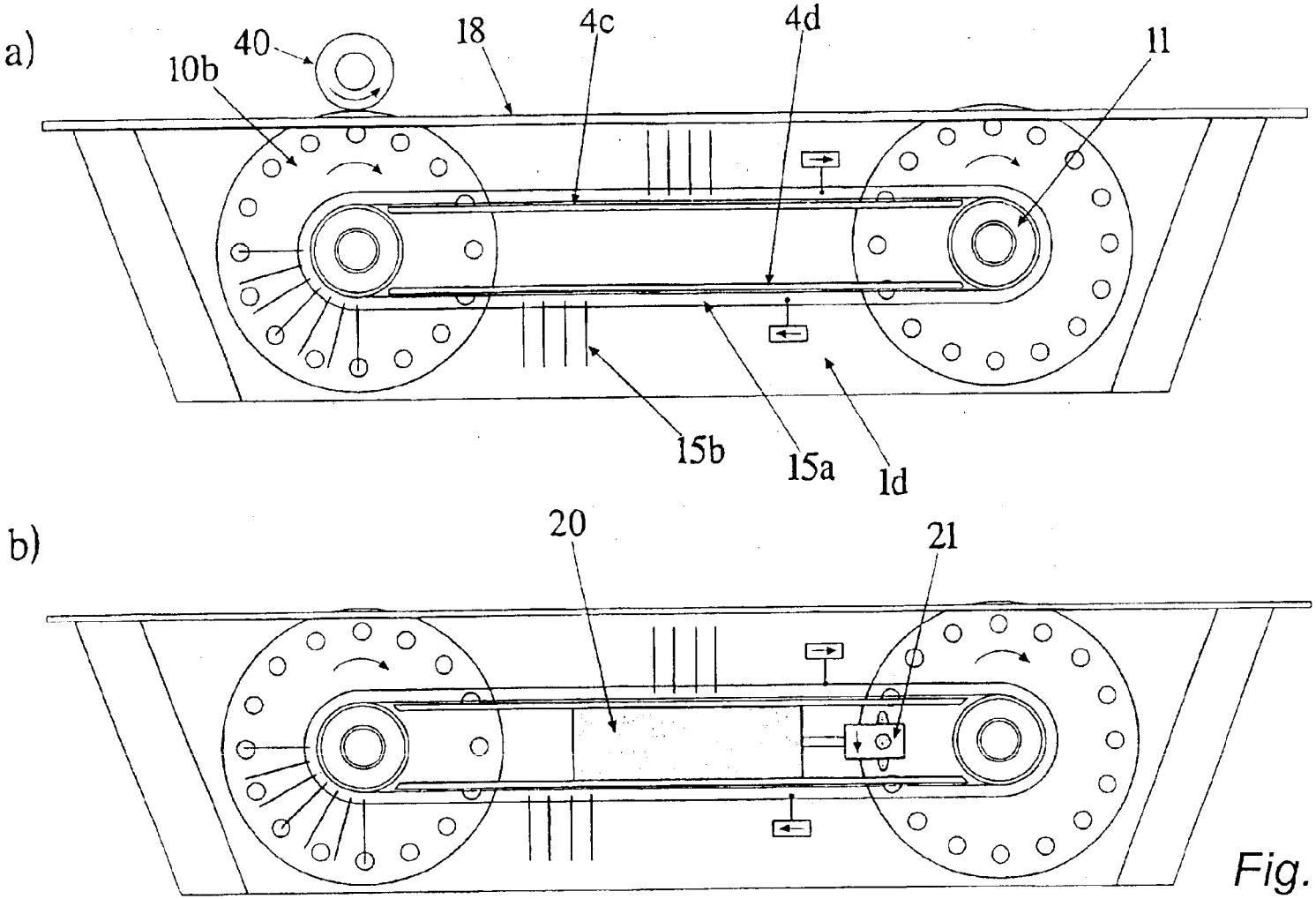
FIGS. 9*a* and *b* show the inside top views of the self-guiding yarn carrier with the protruding wheel for turning it from outside and with an installed motor for turning the wheel from within.
Figure 10:
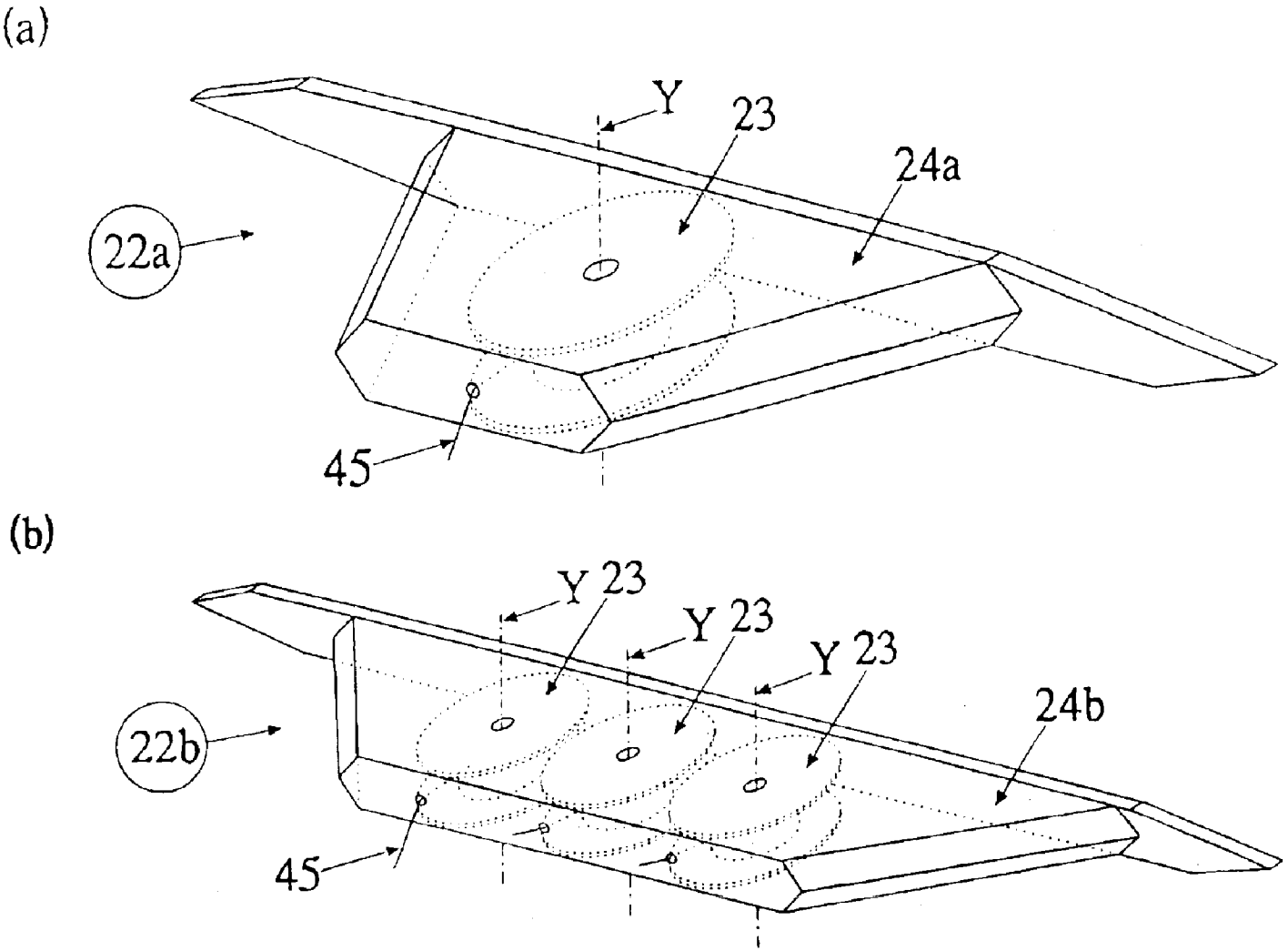
FIGS. 10*a, b, c* and *d* show the possibilities of using the guiding nose with yarn spools that have one axis of rotation, wherein the rotational axis of the spool may occur either perpendicular or parallel to the axis of the guiding nose and the spool carrier may carry one or more than one such spools besides the possibility of the guiding nose itself functioning as a carrier of spool.
Figure 10:
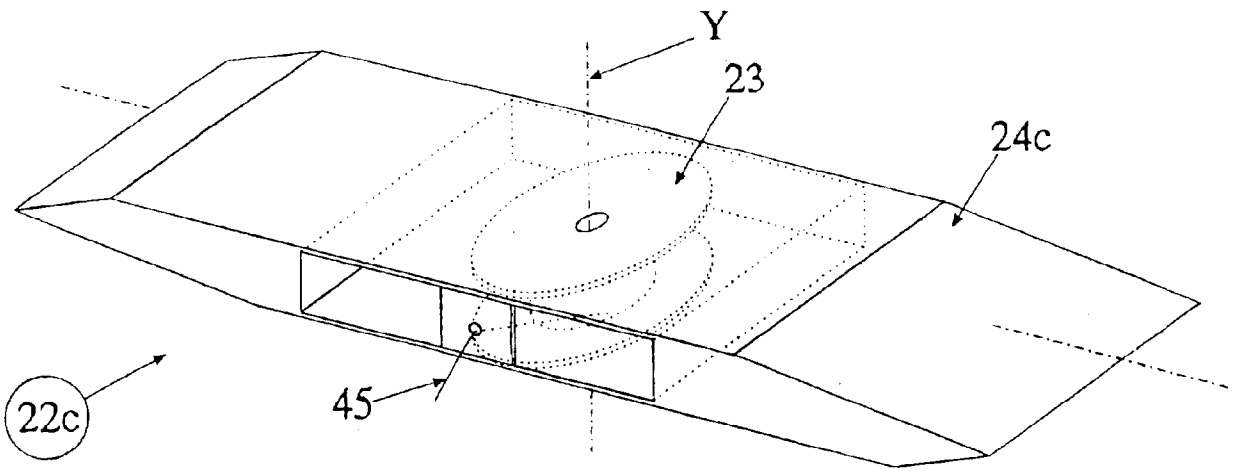
Figure 10:
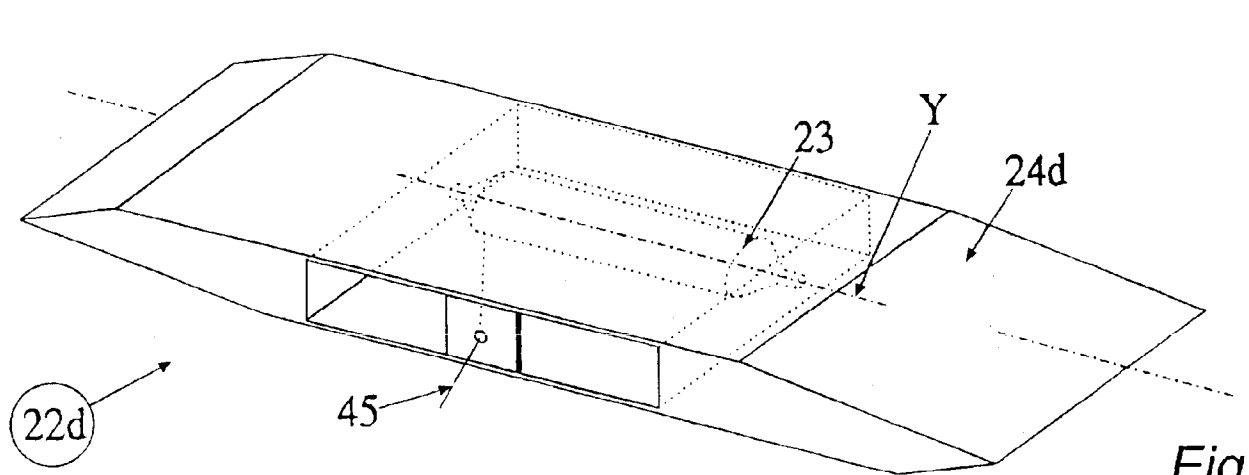

The manner in which the offset tips (18*a*, 18*b*) direct the carrier (1*x*) to traverse in the same linear path and yet capable of laying the yarn (45) in two different paths relative to a layer of the multiple layer warp/axial yarns in the 3D-weaving and noobing processes is sequentially shown in FIGS. 7 and 8 respectively. For exemplifying the point, only one horizontal layer has been shown in FIGS. 7 and 8. The same working applies to all other horizontal as well as the vertical layers. To understand the working of the traversal of the self-guiding carrier (1*y*) in the vertical direction, the same figures can be referred to after turning them by 90°. In this case, the working will refer to one vertical layer and will be similarly applicable to all other vertical layers. Accordingly, in FIG. 7 the back and forth linear traversal of the self-guiding carrier (1*y*) in the upper and lower sheds in the 3D-weaving process is illustrated, and FIG. 8 refers to its back and forth linear traversal over and under a layer of axial yarns in the uniaxial noobing process. The traversals indicated in FIGS. 7 and 8 refer to one cycle of horizontal traversal. In practice horizontal and vertical traversal cycles will be carried out alternately. Thus one cycle of the process will include the carrier's (1*y*) back and forth traversals in the horizontal and vertical directions.

In FIG. 7*a* is shown an open shed with the white warp ends at its level position and the grey warp ends raised up. The axis of the carrier (1*y*) occurs in a straight line with the level position of the warp. At the start of the process cycle, the carrier with the attached guiding nose, and located at the right side of the warp, is about to enter into the formed upper shed. In FIG. 7*b* is shown the carrier moving in its forward direction. The tip of the guiding nose, which is above the level position of the warp, directs the carrier into the formed upper shed. At the same time, the carrier deflects the warp yarns laterally by a small distance that is no more than the distance that is just required for the carrier to pass through unhindered. FIG. 7*c* shows the carrier traversing through the shed. In FIG. 7*d* is shown the carrier emerging from the shed. FIG. 7*e* shows the carrier on the left side of the levelled warp ends and the laid-in weft interlacing with the warp yarns. Next, as shown in FIG. 7*f*, the lower shed is formed with the white warp ends remaining at its level position and grey warp ends displaced downwards. As shown, the carrier is about to enter into the formed lower shed in reference to its level position. In FIG. 7*g* is shown the carrier moving in its forward direction. The tip of the guiding nose, which is now below the level position of the warp, directs the carrier into the formed lower shed. At the same time the carrier deflects the warp yarns laterally by a small distance that is no more than the distance that is just necessary for the carrier to pass through unhindered. FIG. 7*h* shows the carrier traversing through the shed. In FIG. 7*i* is shown the carrier emerging from the shed. FIG. 7*j* shows the carrier on the right side of the levelled warp ends and the laid-in weft interlacing with the warp yarns.

It will now be observed that although the carrier (1*y*) moves in the same linear path back and forth, the special construction of its guiding nose (18) directs the carrier (1*y*) to guide itself in the upper and lower sheds. This way the weft yarn is laid in two different sides of the warp layer's level position. Also, the shed opening does not have to be more than what is just necessary because the carrier (1*y*) itself deflects the warp yarns laterally by the minimum distance required. Also, as the carrier (1*y*) passes through the shed, the warp yarns immediately revert to their assigned positions. They do not have to be maintained highly separated until the carrier (1*y*) has completely emerged out of the shed. The weft, which has been shown to be discontinuous, will in practice be a continuous length.

The above description fully applies to the traversal of the carrier (1*y*) in the vertical direction. The only difference will be that the warp ends would be forming right side shed (FIG. 7*a*) and the left side shed (FIG. 7*f*) in reference to its level position and the carrier (1*y*) traversing upwards and downwards respectively as can be understood by turning FIG. 7 by 90°.

In connection with the uniaxial noobing process, FIG. 8*a* shows the axial yarns and the axis of the carrier (1*y*) occurring in a straight line which is referred to as the level position. As there is no shedding operation involved in the uniaxial noobing process, the axial yarns remain at the level position all through. As shown in FIG. 8*a*, the carrier (1*y*) at the start of the process cycle is located at the right side of a row of axial yarns and is about to move forward. In FIG. 8*b* is shown the carrier moving in its forward direction from right to left side of the row of axial yarns. The tip of the guiding nose, which is above the level position of the row of axial yarns, deflects the axial yarns downwards and thus guides the carrier above the row of axial yarns. The carrier deflects the axial yarns laterally by a distance that is no more than the just required. FIG. 8*c* shows the carrier traversing above the row of axial yarns. In FIG. 8*d* is shown the carrier emerging from over the row of axial yarns. FIG. 8*e* shows the carrier on the left side of the row of axial yarns that remain at level position and the laid binding yarn lying straight and over the row of axial yarns. Next, as shown in FIG. 8*f*, the carrier is moving in its forward direction from left to right side of the row of axial yarns. This time the tip of the guiding nose, which is below the level position of the row of axial yarns, deflects the axial yarns upwards in reference to the level position and thus directs the carrier below the row of axial yarns. The carrier deflects the axial yarns laterally by a distance that is no more than what is just required. FIG. 8*g* shows the carrier traversing below the row of axial yarns. In FIG. 8*h* is shown the carrier emerging from below the row of axial yarns. FIG. 8*i* shows the carrier on the right side of the row of axial yarns that remain at the level position and the laid binding yarn lying straight and below the row of axial yarns.

It is the characteristic of the uniaxial noobing process that the binding yarns occur straight between the corresponding adjacent horizontal and vertical layers of the axial yarns. There is no shedding operation in this process and therefore there is no interlacing of the involved yarns. The indicated laid binding yarn will in practice occur as a continuous loop around the row of axial yarns.

It will now be observed that although the carrier (1*y*) moves linearly in the same path in its back and forth traversal every cycle, the special construction of its guiding nose (18) directs the carrier (1*y*) to guide itself above and below the row of axial yarns. This way the binding yarn is laid in two different sides of the row of axial yarns. Also, the lateral deflection of the axial yarns is just that is necessary because the carrier (1*y*) itself displaces the axial yarns laterally by the required distance. Also, as the carrier (1*y*) passes over and below the row of axial yarns, these yarns immediately revert to their assigned positions. They do not have to be kept deflected until the carrier (1*y*) has fully traversed.

The above description of the carrier's (1*y*) traversal in horizontal direction fully applies to the traversal of the carriers (1*y*) in the vertical direction. The only difference will be that the axial yarns would be deflected to the left side (FIG. 8*a*) and the right side (FIG. 8*f*) in reference to its level position during the carrier's (1*y*) upwards and downwards traversal respectively as can be understood by turning FIG. 8 by 90°.

Figure 6:
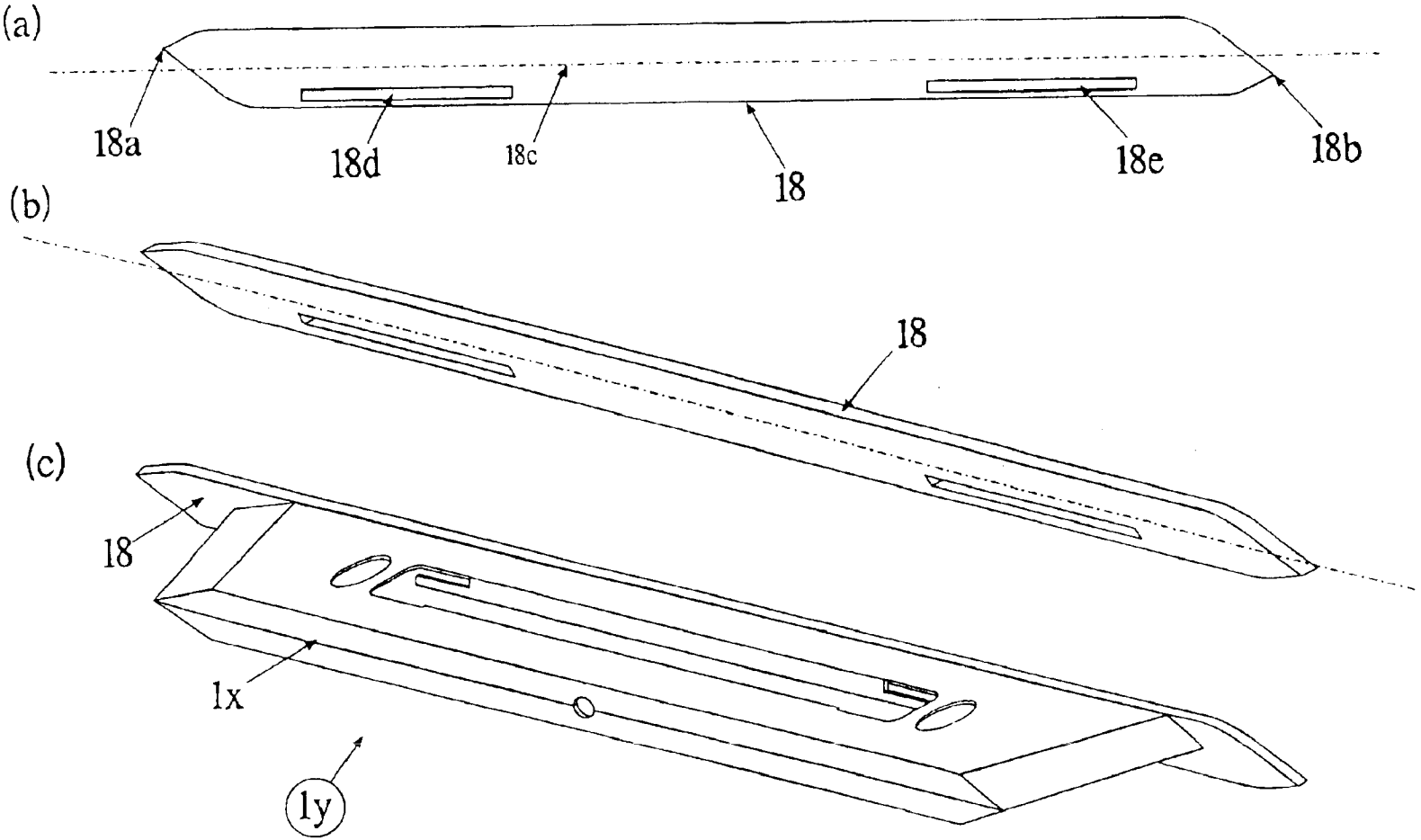
FIGS. 6*a, b* and *c* show the constructional features of the guiding nose as viewed from front, its three-dimensional view and its location in relation to the cartridge.

It was indicated earlier in reference to FIG. 1 that the cartridge case parts (1*a* and 1*d*) are provided with openings (6*a*–6*d*) on its back walls (1*b* and 1*e*). It was also mentioned that the openings (6*c* and 6*d*) in the bottom case (1*d*) were employable to accommodate wheel (10). The location of the wheel assembly (12) in the case part (1*d*) was shown in FIG. 3*d*. As can be seen in that figure, a part of the flange (10*b*) of the wheel assembly (12) protrudes out from the wall (1*e*) through each of the openings (6*c* and 6*d*). The purpose of having the flange (10*b*) protruding out of the cartridge case (1) is to be able to turn the wheel (12) by an external driver. Such a driving of either of the two wheels (12) is essential to wind yarn (45) into the cartridge (after the carrier (1*x*) has exhausted the contained yarn) and to take-up the slackness in the yarn (45) (after the carrier (1*x*) has traversed from one side to the opposite). As the guiding nose (18) is fixed to the back walls (1*b* and 1*e*) of the case parts (1*a* and 1*d*) respectively, the guiding nose (18) is also provided with openings (18*d* and 18*e*) as indicated in FIG. 6. As can be inferred from FIG. 9*a*, an external driver (40) in the form of either a driving wheel or belt could make contact with the protruding part of the wheel flange (10*b*) of either of the two assembled wheels (12) to turn it, and hence move the flanged belt (15), when required.

In certain situations it may be desirable and advantageous to positively let off highly tensioned yarn and take up slack yarn that is arranged on the flanged belt (15). To achieve this, a suitable electric motor (20) can be installed in the opening (3*a* and 3*b*) of the case parts (1*a* and 1*d*) as shown in FIG. 9*b*. A driving wheel (21) having teeth that can mesh with the perforations (10*c*) of the wheel (12) can be attached to the motor (20). The motor (20) can be energised through suitable electrical contacts located on the cartridge case (1). Such an electrical contact can be had either continuously during the traversal of the carrier (1*y*) (e.g. through the guiding nose (18), as one end of it can be had in contact with an electrical source) or intermittently (e.g. when the carrier (1*y*) has docked into its housing after its traversal).

It may be mentioned here that, unlike in the conventional 2D weaving process where the shuttle is propelled negatively (i.e. by throwing it), in the 3D-weaving and uniaxial noobing processes the employed multiple carriers (1*y*) have to be traversed under positive control. This is necessary to manage reliably the large number of the carriers (1*y*) that will be involved in the process and also to avoid any mishap that might arise under the influence of gravity, especially with the carriers (1*y*) of the vertical set. The reliable traversal of multiple carriers in a given direction gains even more importance when two or more carriers are to be traversed in the same path, either in the same direction or opposite, such as during the production of cross-sectional profiles like H, E, B etc. in separate parts. Accordingly, the guiding nose (18) could be used for the positive traversal of the yarn supply source (1*x*). To achieve this, the rear side of the guiding nose (18) could have either teeth or perforations so that it could function as a rack that could be engaged with a pinion or a suitable wheel for moving. There could also be provided a profiled groove, such as 'T', for guiding it on matching tracks so that the carrier (1*y*) can move in a linear guided path and does not come off from the support during traversal. Alternatively, the guiding nose (18) could be of a material that can adhere magnetically to an electromagnet attached to, for example, a telescopic arm that can traverse the yarn carrier (1*y*) from one side of the warp to the opposite. In yet another way, the guiding nose (18) could have a suitable profile, for example, it could be of H cross-section or even a box beam. The rib of the H profiled beam could be used for holding mechanically the carrier (1*y*) during transportation. The mechanical gripping could be done even pneumatically. Another possibility could be that of having either a mechanical or an electromechanical arrangement within the guiding nose (18) that can be engaged with and disengaged from, for example, the carrier driving arm. Alternatively, a motor can be installed to drive the carrier (1*y*).

Apparently, the use of such a guiding nose (18) could also be suitably extended to transport conventional yarn spools that have one axis of rotation, Y. For example, in FIG. 10*a* is shown a carrier (22*a*) comprising case (24*a*) containing such a spool (23). It could also be attached to a case (24*b*) to have carrier (22*b*) that holds more than one such spool (23) as shown in FIG. 10*b*. The guiding nose (18) could be made broader and modified so that it becomes a case (24*c*) by itself to be a carrier (22*c*) to contain the spool/s (23) and its driving motor within itself as exemplified in FIG. 10*c*. In these examples the axis (Y) of the spool/s (23) will occur perpendicular to the longitudinal axis of the carrier. Alternatively, when using a pirn-like spool (23) in guiding nose case (24*d*) of the carrier (22*d*), as indicated in FIG. 10*d*, its axis Y will occur parallel to the longitudinal axis of the carrier (22*d*). As can be seen now, the concept of offset or displaced tips can be used to produce different types of carriers.

As in the 3D-weaving and uniaxial noobing processes the two sets of weft/binding yarn carriers are required to be moved alternately in a mutually perpendicular direction, either each or some of these carriers (1*y*) of the two sets could be equipped with a special form of dent for carrying out the beating-up operation. Thus, the set of weft/binding yarns that has been laid by the carriers (1*y*) of one set could be subsequently beaten-up by the dent carrying carriers (1*y*) of the other set. This way the picking and beating-up operations could be combined in one step and thereby render the 3D textile forming processes efficient.

To achieve the said beating-up, a basic form of the dent (27) is indicated in FIG. 11*a*. The shown dent (27) is essentially formed from a wire that may not necessarily have the circular cross-section. It has three characteristic sections: the fixing section (27*a*), the guiding and weft/binding yarn displacing section (27*b*), and the packing section (27*c*). The fixing section (27*a*) is intended for attaching the dent (27) to the carrier (1*y*). The attachment could be done in a variety of ways, both fixed and movable, such as welding, screwing (when the ends are threaded), gripping (through suitable construction of the carrier (1*y*)), guided in a sleeve under spring pressure etc. In an alternative construction the fixing section could also be made flexible, e.g. by hinging, so that the dent (27) can bend a little to align automatically with the angle of the disposed converging warp/axial yarns through which it is required to pass. The second section (27*b*) are two in number and occurs at an angle relative to the packing section (27*c*) of the dent (27). It is intended to guide the whole dent (27) through the shed/adjacent layers of warp/axial yarns progressively without hindrance and also at the same time progressively displace the weft/binding yarns of the other set, that have been laid previously, towards the plane of fabric-fell. The two units of the second section (27*b*), which are similar, will not be functioning simultaneously but one at a time depending on the traversal direction of the carrier (1*y*). The unit (27*b*) that is on the leading side of the carrier (1*y*) will be the working unit. The packing section (27*c*) is intended to align or firm up the previously laid weft/binding yarns at the plane of fabric-fell with or without the spring action of the wire. Although this section (27*c*) has been indicated to be flat, it could be also had in forms like 'V' and 'U'. In an alternative construction, the second and third sections (27*b* and 27*c*) of dent (27) could be combined so that the new dent would be one curved section.

In FIG. 11*b* is shown the location of dent (27) relative to the carrier (1*x*). The assembly of the beating-up dent (27) and the carrier (1*x*) may now be referred to as the beating-up carrier (1*z*).

Depending on the requirements of the textile-forming process, the dent (27) could be modified to be relatively stiffer and more stable as exemplified by dent (28) in FIG. 11*c*. Further, it could be either bent at its fixing section so as to correspond with the angle of the warp/axial yarn layer when disposed in a converging configuration or it could be suitably hinged so that it could align automatically with the disposed angle of the converging warp/axial yarns. A construction of the modified dent (28) is exemplified in FIG. 11*c*. As can be seen, the modified dent (28) differs from the previous dent (27) essentially in that it is made from blanked sheet material instead of a wire and with suitable reinforcing members (28*f*) to impart stiffness and stability. The exemplified dent (28) too has the three characteristic sections: (28*a*) for attaching it to the carrier (1*x*), (28*b*) for guiding it through the warp/axial yarn layer and deflecting the weft/binding yarns, and (28*c*) for packing the weft/binding yarns at the plane of fabric-fell. An opening (28*e*) provides space for the yarn that emerges through the opening (7) of the carrier (1*x*). In yet another alternative form, using a combination of wire and sheet material could also produce the dent. In such a construction the fixing section and the guiding and weft/binding yarn-displacing section could be made from sheet material and the packing section from a wire. To reduce friction between the dent (27/28) and the warp/axial yarns through which it will pass, the dent can be coated with a suitable material like PTFE.

Figure 12:
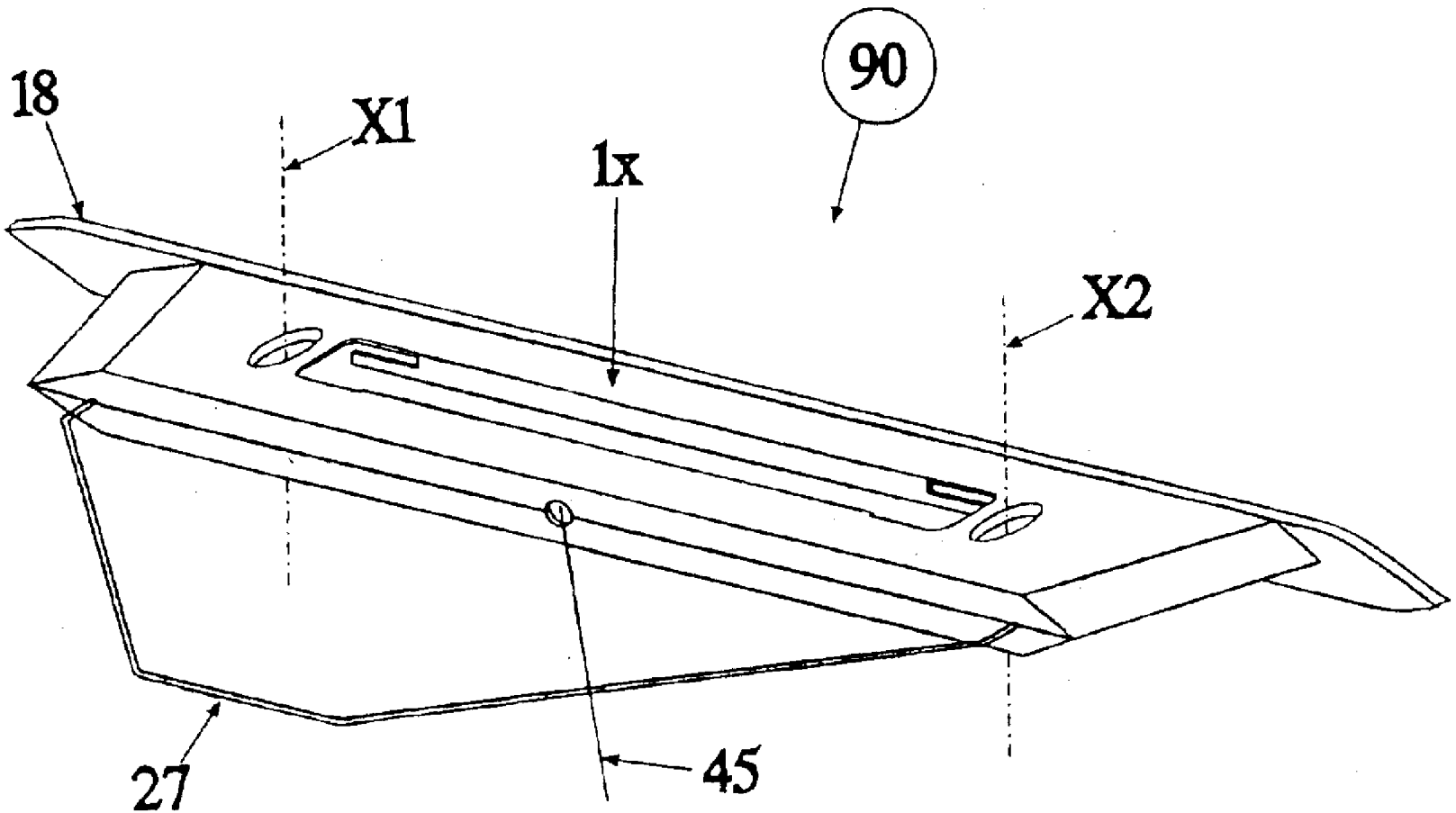
FIG. 12 shows an assembly of the cartridge-like yarn carrier, the guiding nose and the beating-up dent.

An assembly of the yarn carrier (1*x*) carrying yarn (45), guiding nose (18) and the dent (27) is illustrated in FIG. 12 to indicate their relative locations. Such an assembly may now be referred to as the yarn supplying cum beating-up means (90).

Figure 13:
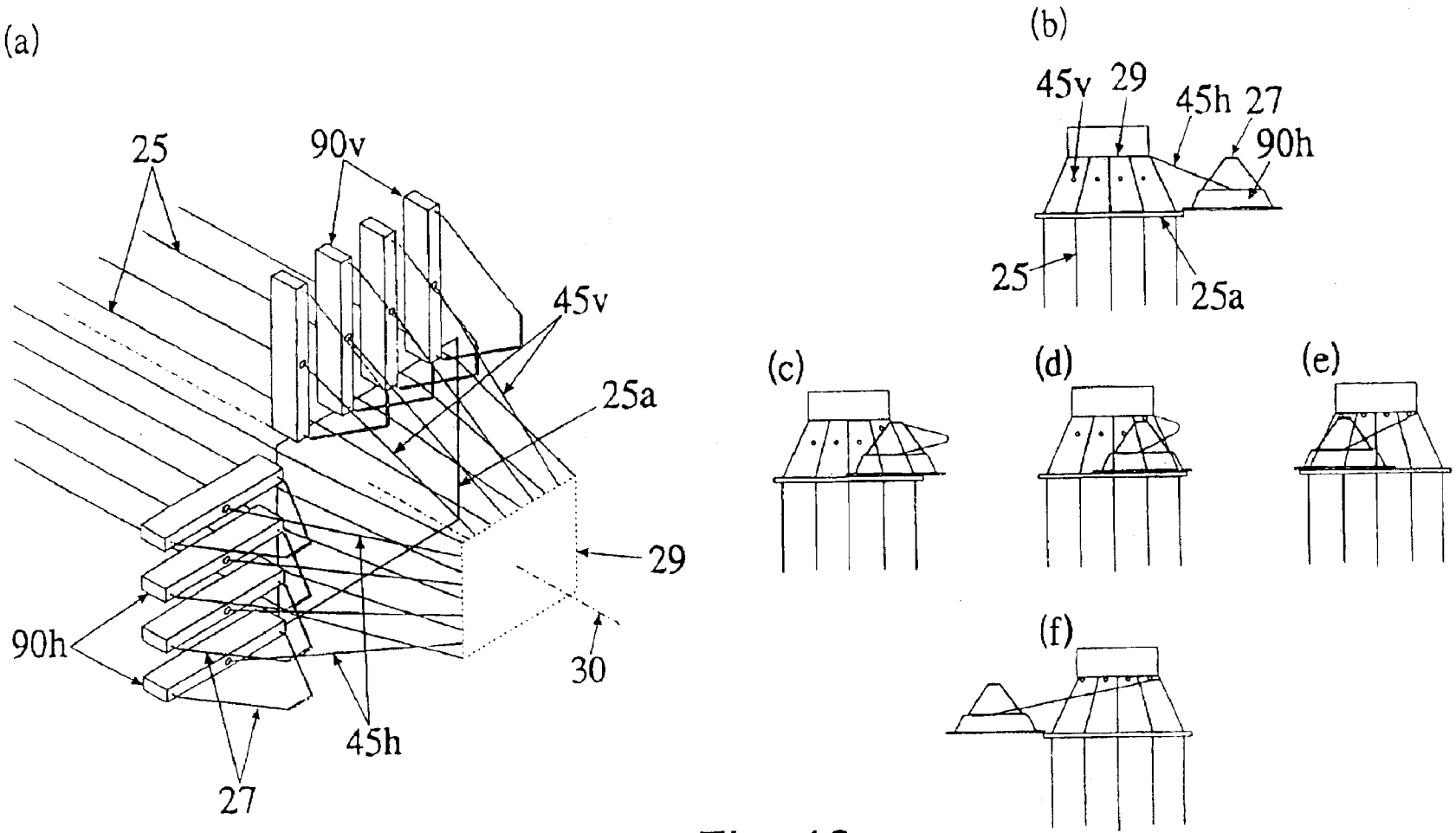
FIGS. 13*a* and *b*–*f* show the relative arrangement of various elements in the 3D-weaving and uniaxial noobing processes and the simultaneous laying of yarn and non-reciprocatory beating-up operation as viewed from top.
Figure 14:
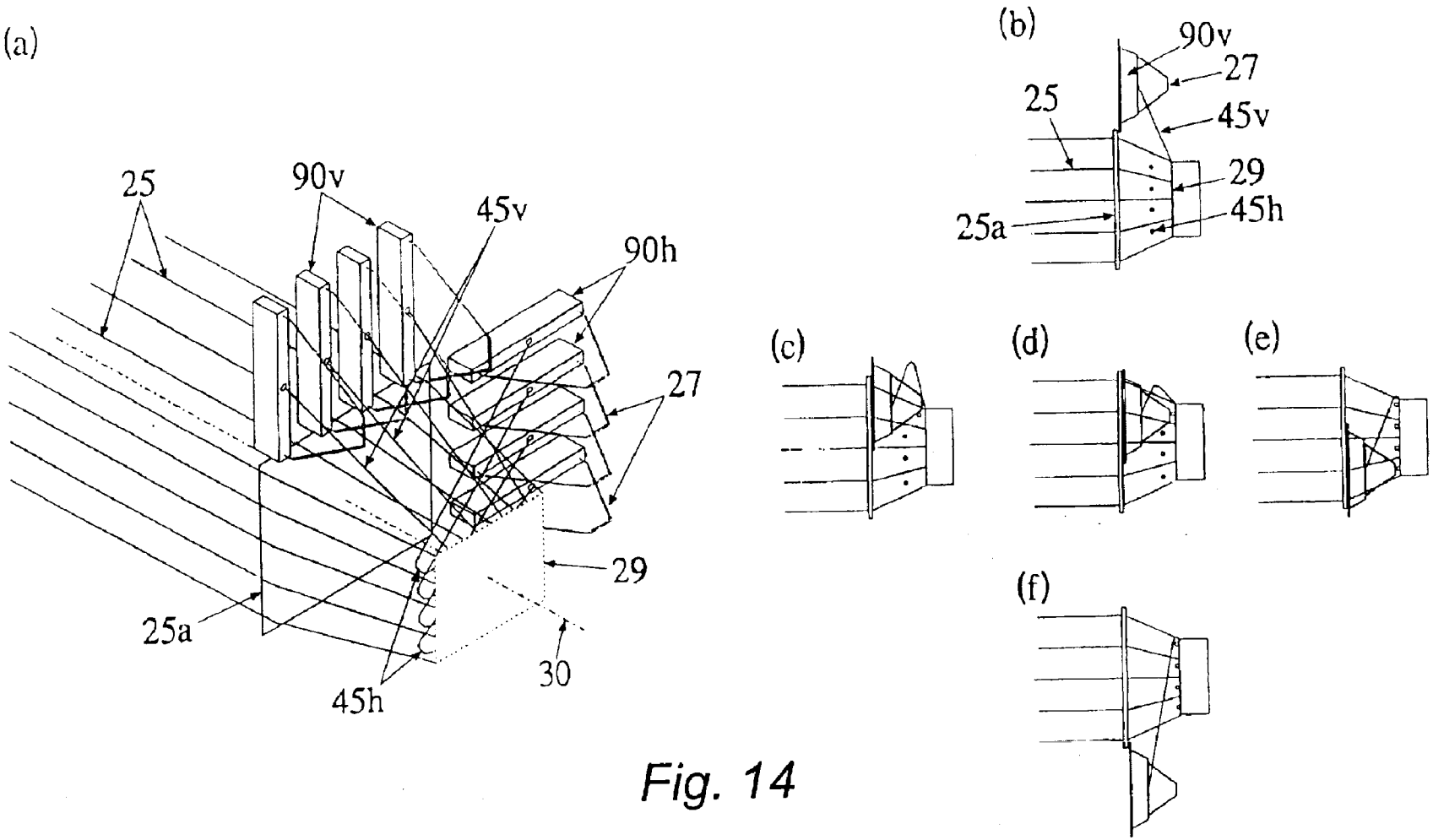
FIGS. 14*a* and *b*–*f* show the relative arrangement of various elements in the 3D-weaving and uniaxial noobing processes and the simultaneous laying of yarn and non-reciprocatory beating-up operation as viewed from the side.

The method of simultaneously carrying out the picking and beating-up operations employing the means (90) is shown schematically in FIGS. 13 and 14.

In FIG. 13*a* is shown the relative arrangement of the warp/axial yarns (25) and its support plate (25*a*), the vertical set of carriers (90*v*) located at the top side of the warp/axial yarns (25), the horizontal set of carriers (90*h*) located at the left side of the warp/axial yarns (25), the vertical set of weft/binding yarns (45*v*) and the horizontal set of weft/binding yarns (45*h*). It may be assumed that the vertical set of weft/binding yarns (45*v*) have just been laid through the warp/axial yarns (25) and the horizontal set of weft/binding yarns (45*h*) are now to be laid in a given process cycle. Accordingly, the horizontal set of carriers (90*h*) will be required to move from the left to the right side of the warp/axial yarns (25).

In FIGS. 13*b*–13*f* are shown simplified sequential views from the top of warp to indicate clearly the method of simultaneous picking and beating-up operations relating to the horizontal carriers (90*h*). FIG. 13*b* shows the carriers (90*h*) about to enter the warp/axial yarns (25). FIG. 13*c* shows dents (27) entering into the warp/axial yarns (25) and the previously laid set of vertical weft/binding yarns (45*v*) being pushed toward the plane of fabric-fell (29) by dents (27) as the carriers (90*h*) traverses in its forward direction. FIG. 13*d* shows dents (27) commencing the beating-up of the set of vertical weft/binding yarns (45*v*) at the plane of fabric-fell (29). FIG. 13*e* shows the carriers (90*h*) beginning to emerge from the warp/axial yarns (25) and the dents (27) completing the beating-up of yarns (45*v*) at the plane of fabric-fell (29). FIG. 13*f* shows the fully emerged carriers (90*h*) and the yarns (45*v*) aligned at the plane of fabric-fell (29). During the same time when the carriers (90*h*) are traversing through the warp/axial yarns (25), horizontal weft/binding yarns (45*h*) are also being laid.

As just described in the foregoing, FIG. 14*a* shows the relative arrangement of the warp/axial yarns (25) and its support plate (25*a*), the vertical set of carriers (90*v*) located at the top side of the warp/axial yarns (25), the horizontal set of carriers (90*h*) located at the right side of the warp/axial yarns (25), the vertical set of weft/binding yarns (45*v*), the horizontal set of weft/binding yarns (45*h*). As the horizontal set of weft/binding yarns (45*h*) has just been laid through the warp/axial yarns (25), the vertical set of weft/binding yarns (45*v*) are now to be laid. Accordingly, the vertical set of carriers (90*v*) is moved from the topside to the bottom side of the warp/axial yarns (25).

Similar to the earlier described working, in FIGS. 14*b*–14*f* are shown simplified sequential views from the side of warp to indicate clearly the method of simultaneous picking and beating-up operations relating to the vertical carriers (90*v*). FIG. 14*b* shows the carriers (90*v*) about to enter the warp/axial yarns (25). FIG. 14*c* shows dents (27) entering into the warp/axial yarns (25) and the previously laid set of horizontal weft/binding yarns (45*h*) being pushed toward the plane of fabric-fell (29) by dents (27) as the carriers (90*v*) traverse downwards. FIG. 14*d* shows dents (27) commencing the beating-up of the set of vertical weft/binding yarns (45*h*) at the plane of fabric-fell (29). FIG. 14*e* shows the carriers (90*v*) beginning to emerge from the warp/axial yarns (25) and the dents (27) completing the beating-up of yarns (45*h*) at the plane of fabric-fell (29). FIG. 14*f* shows the fully emerged carriers (90*v*) and the set of yarns (45*h*) aligned at the plane of fabric-fell (29). During the same time when the carriers (90*v*) are traversing through the warp/axial yarns (25), vertical weft/binding yarns (45*v*) are also being laid.

As can be observed, in such 3D textile forming processes the picking and beating-up operations can be carried out simultaneously. Thus, as the set of horizontal carriers (90*h*) move from one side to the opposite, they beat-up the previously laid set of vertical weft/binding yarns (45*v*) at the plane of fabric-fell (29) and simultaneously lay the horizontal set of weft/binding yarns (45*h*) through the warp/axial yarns (25). Similarly, as the set of vertical carriers (90*v*) move from one side to the opposite, they beat-up the previously laid set of horizontal weft/binding yarns (45*h*) at the plane of fabric-fell (29) and simultaneously lay the vertical set of weft/binding yarns (45*v*) through the warp/axial yarns (25).

It will be noticed through the FIGS. 13 and 14 that in this method of beating-up of the weft/binding yarns (45*h*/45*v*), the dents (27) (or the carriers (90*h*/90*v*)) do not reciprocate in the axial direction (30) of warp, as happens in the conventional 2D-weaving process. Such a method of beating-up may now be referred to as the non-reciprocatory type of beating-up operation.

Nonetheless, if required, it is possible to carry out the conventional reciprocatory beating-up method too. To achieve this, the carriers (90) could be halted midway, if required, when traversing through the warp/axial yarns (25) and subjected to a forward and backward motion in the direction of the axis (30) by reciprocating the plate (25*a*) that supports the warp/axial yarns through a suitable working arrangement. This is possible because the carriers (90) are driven under positive control and can be halted at any predetermined point. Alternatively, the dent (27/28) could be placed in the carrier under spring pressure and partly emerging from the rear side of the carrier (1*x*) so that it gets reciprocated when passing over specified raised points on the plate (25*a*).

Figure 15:
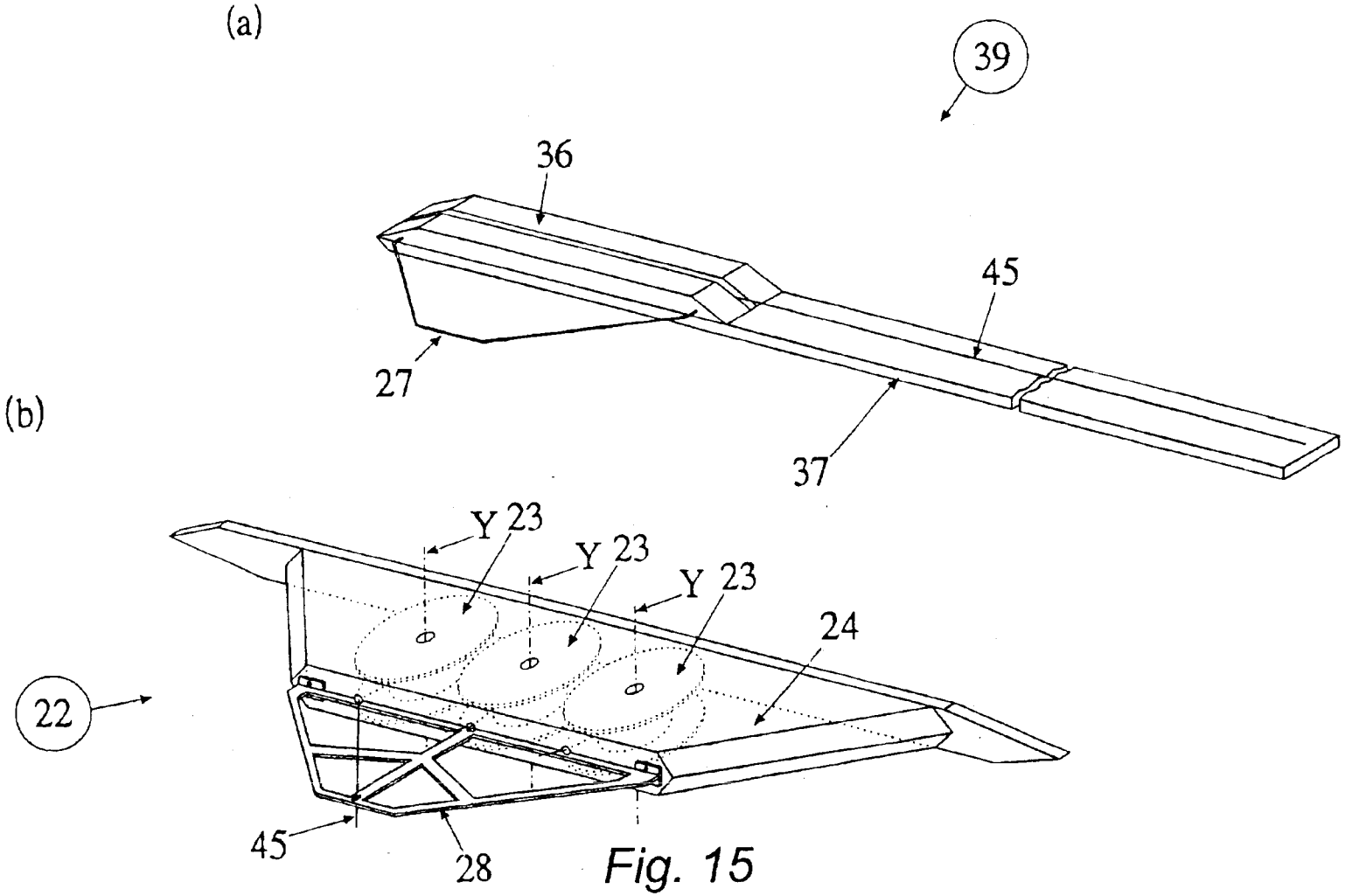
FIGS. 15*a* and *b* show the attachment of a beating-up reed dent to the rapier head and a spool carrier to achieve simultaneous laying of yarn and beating-up operation.

As it is possible to employ multiple rapiers in place of carriers (1*y*) in the vertical and horizontal directions of the 3D-weaving and uniaxial noobing processes, the dent (27/28) could be similarly attached to the head/band (36/37) of the rapier system (39) as shown in FIG. 15. The non-reciprocatory beating-up action would remain as before. It may be mentioned here that the indicated rapier head (36) in FIG. 15 could be a means for inserting weft/binding yarn by way of transferring the yarn in the form of either a loop or tip between the warp/axial yarns. Accordingly, a knitting needle could also be employed as a rapier that can insert yarn in the form of a loop. Also, the rapier head's (36) supporting band (37) could be of either the flexible or rigid type.

Similarly and as can be imagined now, simultaneous beating-up and laying of yarn (45) between the warp/axial yarns (25) could also be achieved by attaching the dent (27/28) to the different types of carriers (22*a*–22*d*), which can carry one or more yarn spools (23) of the type having one axis of rotation Y, described earlier in reference to FIG. 10. In FIG. 15*b* is exemplified the dent (28) attached to carrier (22*b*) indicated earlier to form the carrier (22) for accomplishing simultaneous laying of yarn and beating-up on the lines described in the foregoing.

It would be also apparent that the described non-reciprocatory beating-up method could be applied even if there was no yarn in the means (90). This approach of beating-up can be useful in those instances of 3D textile production where certain weft/binding yarns of either horizontal or vertical set are not required to be laid but beating-up of the weft/binding yarns of the other set that have been laid should be carried out. For example, in the production of tubular and 'H', 'T' etc. profiled 3D textiles.

Figure 11:
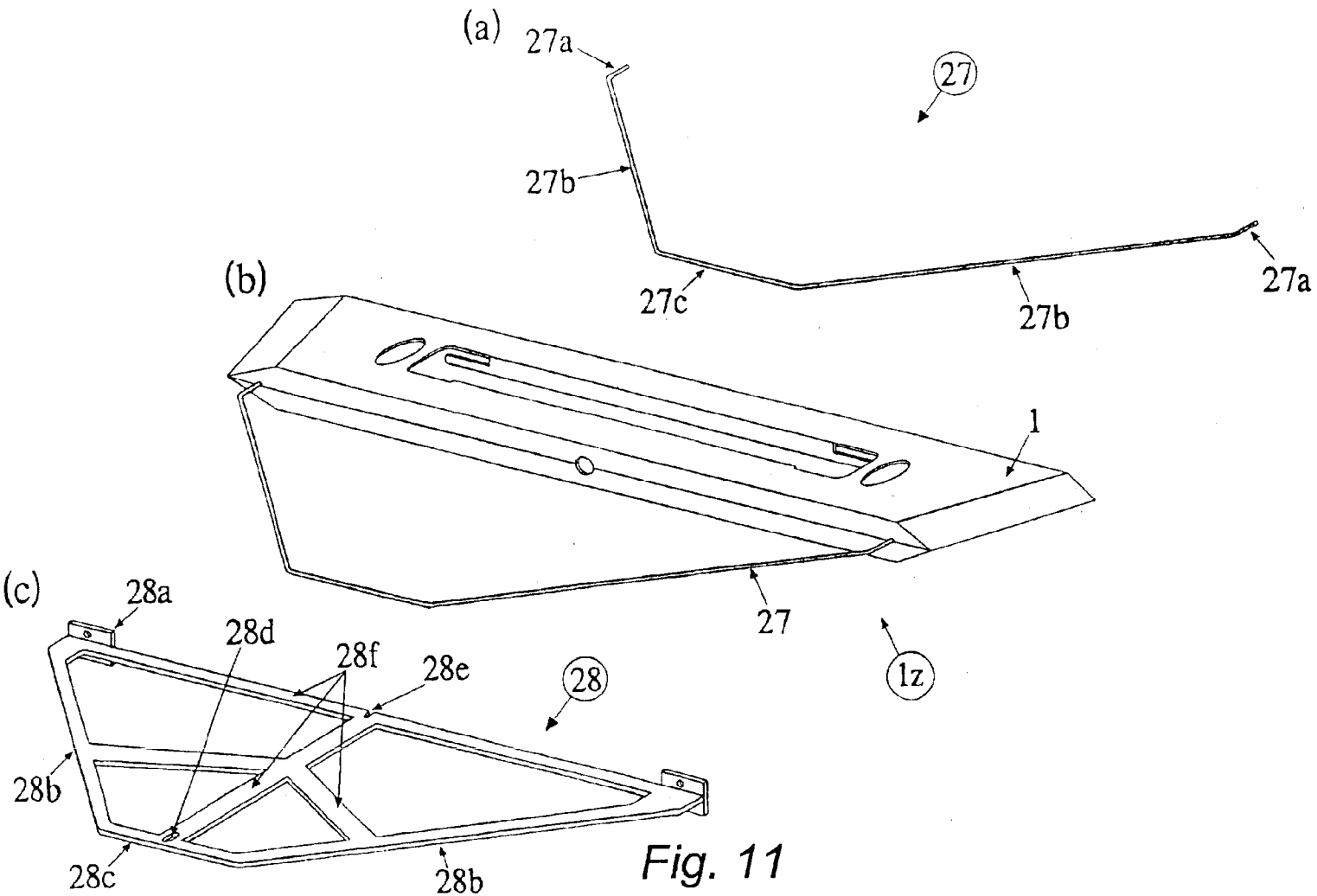
FIGS. 11*a, b* and *c* show the basic form of a beating-up dent that can be attached to the cartridge-like yarn carrier, the dent attached to the carrier, and another variant of the dent.

It may be mentioned here that the indicated dents (27/28) in FIG. 11 could be modified such that the yarn (45) emerging from the port (7) of the carrier (1*x*) could be guided either to or closer to its packing section (27*c*/28*c*). For example, as shown in FIG. 11*c*, a yarn guide could be installed in the opening (28*d*) located on the packing section (28*c*). This way it would become possible to lay the weft/binding yarns closer to the plane of fabric-fell. An alternative way to bring the yarn closer to the packing section (27*c*/28*c*) would be to have, for example, a tube with suitably located entry and exit ports for conducting the yarn through it instead of employing a dent wire (27). When using dent (28), either a closed or open channel could be built into it to conduct the yarn (45) to the packing section (28*c*) from the opening (7) of the carrier (1*x*). Alternatively, the yarn (45) could also be guided to the packing section (27*c*/28*c*) of the dents (27/28) by guiding it through suitably located yarn-guides.

As mentioned earlier, the described yarn supplying means (1*x*) should not be considered as a weft/binding yarn carrier for 3D-weaving and uniaxial noobing processes only. Such a cartridge (1*x*) could also find use in textile processes where space requirements may impose restrictions on using large cylindrical packages. For example, a carrier (1*x*) of the described characteristics could be used in braiding process with suitable modifications and in place of bulky creels that feed yarns to certain 2D and 3D textile-forming processes. In the braiding process the modified carrier (1*x*) could be traversed in an upright or standing manner such that its axis (8) occurs perpendicular to its traversal direction. The added advantage of using such a yarn carrier (1*x*) will be the possibility to control the tension of the yarn supplied by suitably energising the installed electric motor (20). Of course in such applications there will be no need to attach the guiding nose (18) to the means (1*x*).

The term yarn used above, and which could be handled by the various indicated yarn carriers, should be interpreted broadly, and may e.g. comprise tapes, without deviating from the invention as claimed. The tapes so used could be composed of, for example, fibrous material, metallic foils, polymeric material etc.

Figure 16:
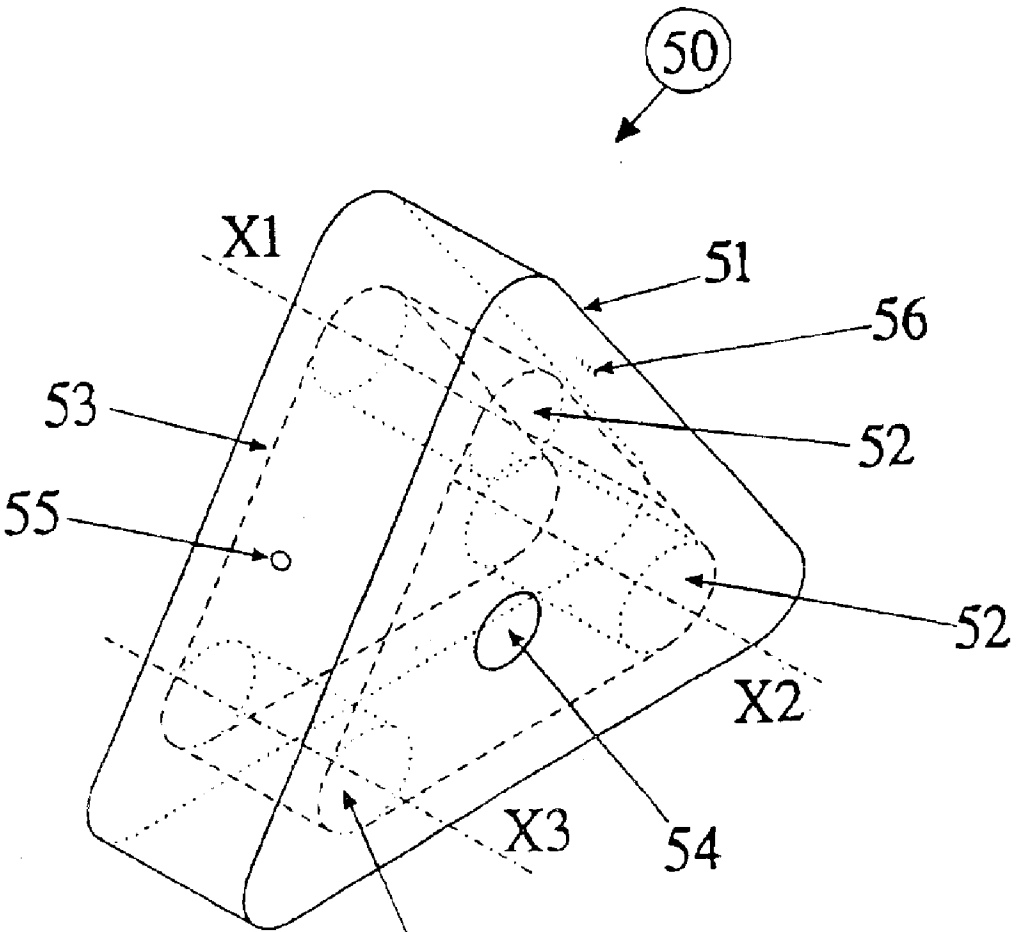
FIG. 16 shows an alternative construction of the yarn supply source having three parallel axes of rotation, to be used in an alternative application.

Further, if necessary, the basic construction of the yarn carrier (1*x*) could be modified to suit a particular application by way of having the yarn about more than two parallel axes of rotation. One such construction is exemplified in FIG. 16 wherein the yarn supplying means (50) is shown to have three parallel axes of rotation (X1, X2 and X3). The working principle of such a means (50) will be the same as that of the carrier (1*x*) and needs no further elaboration. Such a yarn supplying means (50) could perhaps find application as a, for example, weft measuring, storing and feeding device for use with the shuttleless weaving machines. To suit this particular application wherein transportation of the means (50) is not involved and there is available relatively more space, some of the suggested modifications in respect of means (1*x*) could be as follows:

One of the wheels (52) contained in the case (51) could be directly driven by an electric motor.

The belt (53) could be perforated so that the required yarn length could be held onto it by vacuum pressure from below.

The vacuum pressure could be created by connecting the exhaust port (54) on case (51) to a suction pump through suitable connection.

Two ports, one entry (55) and one exit (56), could be provided for the yarn to enter into and exit from the yarn supplying means (50).

It may be mentioned here that in the described means (1*x*) the yarn (45) wound on the flanged belt (15) would not be drawn off axially (i.e. in the direction of the axes X1 and X2), but in the tangential sense (i.e. in the plane perpendicular to the axes X1 and X2). As a result, no twist will be imparted to the yarn during its withdrawal. Also, because the yarn will be enclosed in the cases (1*a*/1*d*), the risk of contaminating and damaging it is virtually eliminated. These points will also be applicable to the yarn supplying means (50).

For satisfactory practical utilisation of the carrier (1*x*), some improvements could be carried out. For example, a window could be provided at a suitable location on the case part (1*a* or 1*d*) to know the yarn material type and amount contained on the flanged belt (15) at any given time. This window could also be helpful in accessing the leading tip of the yarn, which enters through the yarn guide, for engaging the yarn to the flanged belt (15) so that it could be latched for winding. Through this window it is also possible to monitor electronically the amount of yarn remaining on the belt (15). Another improvement could be to install pins at suitable points inside the carrier (1*x*) to guide the yarn through the desired path. Yet another improvement could be to include an electronic system within the carrier (1*x*) to indicate whether it is full/empty, running/stopped etc. for visual attention. Further, pressure-sensitive pins could be considered for incorporation so that the motor (20) can be activated according to the obtaining needs of the yarn tension. For easy and quick assembly and dismantling of the carrier (1*x*), spring clips could be used in conjunction with suitable slits on case (1). There could be provided openings on the front walls (1*c* and 1*f*) of the carrier (1*x*), similar to the openings (6*a*–6*d*) indicated in FIG. 1, to drive the wheel (12) from the front side of the carrier to suit a particular situation. For the same purpose, openings could also be had at the end sides of the yarn cartridge that is of the flat-end type mentioned earlier. An opening for receiving the yarn guide could also be provided at one of the end sides of the flat-end type yarn cartridge. There could also be included rolling pins instead of a yarn guide at the opening (7) for according safety to the passing yarn.

From the foregoing description of the preferred embodiment of the invention it will be clear that all of the objectives set earlier are realizable.

It will now be apparent to those skilled in the art that it is possible to alter or modify the various details of this invention without departing from the spirit of the invention.

Therefore, the foregoing description is for the purpose of illustrating the basic idea of this invention and it does not limit the claims that are listed below.

REFERENCES

Khokar, N., 1996. 3D Fabric-forming Processes: Distinguishing Between 2D-Weaving, 3D-Weaving and an Unspecified Non-interlacing Process. *J. Text. Inst.*, 87, Part 1, No. 1.

Khokar, N. 1997. Doctoral dissertation: 3D-Weaving and Noobing: Characterization of Interlaced and Non-interlaced 3D Fabric Forming Principles, Dept. of Polymeric Materials, Chalmers University of Technology, Gothenburg, Sweden, ISBN 91 7197-492X.

Khokar, N. and Peterson, E., 1998. 3D Fabrics Through the 'True' 3D-Weaving Process, Paper presented at the World Textile Congress 1998, Huddersfield, U.K.

Khokar, N. and Peterson, E., 1999. An Experimental Uniaxial Noobing Device: Construction, Method of Operation, and Related Aspects. *J. Text. Inst.*, 90, Part 1, No. 2.

Khokar, N., 1999. *An Experimental 'True' 3D-Weaving Device*, Paper presented at 3rd Intl. Conference on New Products and Production Technologies for a New Textile Industry, University of Ghent, Belgium.

Khokar, N., 1999. A Classification of Shedding Methods. *J. Text. Inst.*, 90, Part 1, No. 4.

What is claimed is:

1. A method for manufacturing a textile, comprising:

operating at least one yarn insertion device for laying the yarns through warp/axial yarns; and using said yarn insertion device to perform a beating-up operation.

2. A method according to claim 1, wherein the beating-up operation and the laying of yarn is performed essentially simultaneously.

3. A method according to claim 1, wherein the yarn insertion device is traversed in at least one of the directions of the textile thickness and the textile width.

4. A method according to claim 3, wherein the yarn is laid in both the textile thickness direction and the textile width direction, wherein the yarns that have been laid in the direction of the textile thickness are beaten-up by operating at least one yarn insertion device in the textile width direction and the yarns that have been laid in the direction of textile's width are beaten-up by operating yarn insertion device in the textile thickness direction.

5. A method according to claim 1, wherein more than one yarn insertion device is used, each yarn insertion device being operated in one of at least two directions.

6. A method according to claim 5, wherein the yarn insertion devices for at least one direction are operated in groups of at least two.

7. A method according to claim 1, wherein the yarn insertion device is a yarn carrier.

8. A method according to a claim 1, wherein the yarn insertion device is a rapier system.

9. A yarn insertion device for use in textile production, wherein it is traversed back and forth through layers of warp/axial yarns to place the yarn there between, the device comprising:

beating-up dent, extending in the direction towards the fabric-fell when an insertion device is traversed, and the dent comprising at least one inclined portion adjacent to the farthest extended portion.

10. A yarn insertion device according to claim 9, further comprising:

a turnable yarn holder belt/spool on which the yarn is arranged.

11. A yarn insertion device according to claim 10, further comprising:

a case covering at least part of the yarn, being arranged on the yarn holder.

12. A yarn insertion device according to claim 10, wherein the yarn holder comprises a yarn carrying belt on which the yarn is arranged, said belt being turnable relative to the carrier about at least two axes of rotation.

13. A yarn insertion device according to claim 9, wherein the beating-up dent comprises a farthest extended part with an edge being essentially parallel to the traversal direction of the carrier.

14. A yarn insertion device according to claim 9, wherein the beating-up dent comprises an inclined portion adjacent to the farthest extended part on both side thereof in the traversal direction.

15. A yarn insertion device according to claim 9, wherein the beating-up dent is at least partly constructed from an elongated member, including at least one of a wire, flat strip, tube, and being fastened to other parts of the carrier in its ends.

16. A yarn insertion device according to claim 9, wherein beating-up dent is at least partly constructed from a plate member.

17. A yarn insertion device according to claim 9, wherein the beating-up dent further comprises yarn guiding means for guiding the yarn, emanating from the yarn inserting device, to be placed at the fabric-fell.

18. A yarn insertion device according to claim 17, wherein the yarn guiding device is positioned in the vicinity of the farthest extended part of the beating-up dent.

19. A yarn insertion device according to claim 9, wherein the beating-up dents are arranged flexible relative to the rest of the carrier.

20. A yarn insertion device according to claim 9, wherein it is a carrier being elongated in the direction of its traversal, and both end portions of the carrier in the said direction of traversal being tapered and ended in tips occurring oppositely displaced to each other relative to the traversal path of the carrier to render the carrier self-guiding to lay the yarn in two different paths relative to a layer of the warp/axial yarns while the carrier traverses back and forth.

21. A yarn carrier according to claim 12, wherein the two axes are fixed relative to each other.

22. A yarn carrier according to claim 12, wherein the two axes are essentially parallel to each other.

23. A yarn carrier according to claim 12, further comprising:

at least two wheels, arranged to rotate individually about said respective axes of rotation, wherein the yarn carrying belt is mounted on the wheels.

24. A yarn carrier according to claim 12, wherein at least a part of the wheel is provided with a high-friction arrangement, including at least one of perforation, serration, groove, gear teeth and application of a suitable material, for driving the belt through a non-slipping arrangement.

25. A yarn carrier according to claim 12, wherein the yarn carrying belt is flanged to prevent lateral displacement of the yarn carried by it.

26. A yarn carrier according to claim 12, wherein the belt comprises means for gripping the leading end of the yarn.

27. A yarn carrier according to claim 12, wherein the belt is provided with a high-friction arrangement, including at least one of being ribbed, perforated, and coated with anti-slip material, on at least one of the sides.

28. A yarn carrier according to claim 12, further comprising:

a case, covering at least part of the yarn being arranged on the belt.

29. A yarn carrier according to claim 28, wherein the case comprises at least one opening constituting a passageway for the yarn to pass in or out from the case.

30. A yarn carrier according to claim 29, wherein the yarn carrying belt is flanged to prevent lateral displacement of the yarn, and wherein the flanged belt is open on one side in its cross-sectional shape, such that the open side of the mounted flanged belt faces in the direction of the opening in at least one of its running positions.

31. A yarn carrier according to claim 28, wherein the case, together with the belt, constitutes a cartridge-like unit, said unit being mutually exchangeable.

32. A yarn carrier according to claim 28, further comprising:

at least two wheels, arranged to rotate individually about said respective axes of rotation, wherein the yarn carrying belt is mounted on the wheels, wherein the wheels, belt and yarn are enclosed in the case.

33. A yarn carrier according to claim 32, wherein the case has openings to partly expose the wheels, for turning it from outside of the case for either drawing in or letting out the yarn from the case.

34. A yarn carrier according to claim 28, wherein the case includes one of its longitudinal sides longer than the other to form a taper in the direction of the carrier's width.

35. A yarn carrier according to claim 28, wherein the case is tapered in the thickness direction of the case.

36. A yarn carrier according to claim 12, further comprising:

a driving unit for driving the flanged belt.

37. A yarn carrier according to claim 12, intended to be used for traversing back and forth through layers of warp/axial yarns to place the yarn there between.

38. A yarn carrier according to claim 20, wherein it is provided with means to be operated under positive control, including at least one of as having teeth, perforation, projection, profiled grooves and being of magnetic material.

39. A yarn carrier according to claim 31, wherein the carrier comprises a driving unit, making it a self-driven carrier.

40. A yarn carrier according to claim 26, wherein the means for gripping includes at least one of a slit and hooking arrangement.

41. A yarn carrier according to claim 28, wherein the case essentially enclose the yarn.

42. A yarn insertion device according to claim 11, wherein the case cover essentially encloses the yarn.

* * * * *